US008035666B2

(12) United States Patent
Barnhoefer et al.

(10) Patent No.: US 8,035,666 B2
(45) Date of Patent: Oct. 11, 2011

(54) DYNAMIC BACKLIGHT ADAPTATION FOR BLACK BARS WITH SUBTITLES

(75) Inventors: Ulrich T. Barnhoefer, Sunnyvale, CA (US); Wei H. Yao, Fremont, CA (US); Wei Chen, Palo Alto, CA (US); Barry J. Corlett, San Francisco, CA (US); Jean-Didier Allegrucci, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 700 days.

(21) Appl. No.: 12/145,331

(22) Filed: Jun. 24, 2008

(65) Prior Publication Data

US 2009/0002565 A1 Jan. 1, 2009

Related U.S. Application Data

(60) Provisional application No. 61/016,100, filed on Dec. 21, 2007, provisional application No. 60/946,270, filed on Jun. 26, 2007.

(51) Int. Cl.
*G09G 5/02* (2006.01)

(52) U.S. Cl. ..... 345/698; 348/556; 348/913

(58) Field of Classification Search ..... 345/698; 348/556, 913

See application file for complete search history.

(56) References Cited

U.S. PATENT DOCUMENTS

| | | | | |
|---|---|---|---|---|
| 5,717,422 | A | 2/1998 | Fergason | |
| 5,930,402 | A | 7/1999 | Kim | |
| 6,097,849 | A | 8/2000 | Nevis | |
| 7,003,153 | B1 * | 2/2006 | Kerofsky | 382/168 |
| 7,167,214 | B2 * | 1/2007 | Hirosue | 348/687 |
| 7,454,137 | B2 * | 11/2008 | Lee et al. | 396/282 |
| 7,592,996 | B2 * | 9/2009 | Brown et al. | 345/102 |
| 7,796,143 | B2 * | 9/2010 | Huang | 345/690 |
| 2003/0053690 | A1 | 3/2003 | Trifonov | |
| 2005/0179706 | A1 | 8/2005 | Childers | |
| 2006/0119612 | A1 | 6/2006 | Kerofsky | |
| 2006/0221046 | A1 | 10/2006 | Sato | |

FOREIGN PATENT DOCUMENTS

| | | | |
|---|---|---|---|
| EP | 0675645 | A2 | 10/1995 |
| EP | 0800311 | A1 | 10/1997 |
| EP | 1093295 | A2 | 10/2000 |
| EP | 1231773 | A1 | 2/2001 |
| EP | 1939850 | A1 | 7/2008 |
| WO | 0227656 | A2 | 4/2002 |

* cited by examiner

OTHER PUBLICATIONS

Kerofsky, Louis et al., "26.2: Distinguished Paper: Brightness Preservation for LCD Backlight Reduction", Sharp Laboratories of America, Camas, Washington, USA, 1242 SID 06 Digest.

*Primary Examiner* — Kevin Nguyen
*Assistant Examiner* — Bassam Noaman
(74) *Attorney, Agent, or Firm* — Park, Vaughan, Fleming & Dowler LLP; Steven E. Stupp

(57) ABSTRACT

Embodiments of a system that includes one or more integrated circuits are described. During operation, the system receives a video image, that when displayed, includes a picture portion, a non-picture portion, and a subtitle which is superimposed on at least a subset of the non-picture portion, where the non-picture portion has an initial brightness value. Then, the system scales the brightness of pixels corresponding to a remainder of the non-picture portion of the video image to have a new brightness value that is greater than the initial brightness value to reduce user-perceived changes in the video image associated with backlighting of a display that displays the video image, where the remainder of the non-picture portion excludes the subset of the non-picture portion.

21 Claims, 15 Drawing Sheets

DYNAMIC BACKLIGHT ADAPTATION FOR BLACK BARS WITH SUBTITLES

CROSS REFERENCE TO RELATED APPLICATIONS

This application claims priority under 35 U.S.C. 119(e) to U.S. Provisional Application Ser. No. 61/016,100, entitled "Dynamic Backlight Adaptation," by Ulrich T. Barnhoefer, Barry J. Corlett, Victor E. Alessi, Wei H. Yao and Wei Chen, filed on Dec. 21, 2007, and to U.S. Provisional Application Ser. No. 60/946,270, entitled "Dynamic Backlight Adaptation," by Ulrich T. Barnhoefer, Barry J. Corlett, Victor E. Alessi, Wei H. Yao and Wei Chen, filed on Jun. 26, 2007, the contents of both of which are herein incorporated by reference.

This application is related to: (1) pending U.S. patent application Ser. No. 12,145,368, entitled "Dynamic Backlight Adaptation for Video Images With Black Bars," by Ulrich T. Barnhoefer, Wei H. Yao, Wei Chen and Barry J. Corlett, June 24, 2008, (2) pending U.S. patent application Ser. No. 12,145,388, entitled "Dynamic Backlight Adaptation With Reduced Flicker," by Ulrich T. Barnhoefer, Wei H. Yao, Wei Chen, Barry J. Corlett and Victor E. Alessi, Jun. 24, 2008, (3) pending U.S. patent application Ser. No. 12/145,396, entitled "Synchronizing Dynamic Backlight Adaptation," by Ulrich T. Barnhoefer, Wei H. Yao, Wei Chen and Barry J. Corlett, Jun. 24, 2008, (4) pending U.S. patent application Ser. No. 12/145,125, entitled "Dynamic Backlight Adaptation Using Selective Filtering," by Ulrich T. Barnhoefer, Wei H. Yao, Wei Chen, and Barry J. Corlett, Jun. 24, 2008, (5) pending U.S. patent application Ser. No. 12/145,176, entitled "Gamma-Correction Technique for Video Playback," by Ulrich Barnhoefer, Wei H. Yao, Wei Chen, Barry Corlett and Jean-Didier Allegrucci, Jun. 24, 2008, (6) pending U.S. patent application Ser. No. 12,145,207, entitled "Light-Leakage-Correction Technique for Video Playback," by Ulrich Barnhoefer, Wei H. Yao, Wei Chen and Andrew Aitken, Jun. 24, 2008, (7) pending U.S. patent application Ser. No. 12,145,308, entitled "Color-Adjustment Technique for Video Playback," by Ulrich Barnhoefer, Wei H. Yao, Wei Chen and Barry Corlett, Jun. 24, 2008, (8) pending U.S. patent application Ser. No. 12,145,250, entitled "Technique for Adjusting White-Color-Filter Pixels," by Ulrich Barnhoefer, Wei H. Yao and Wei Chen, Jun. 24, 2008, (9) pending U.S. patent application Ser. No. 12,145,266, entitled "Technique for Adjusting a Backlight During a Brightness Discontinuity," by Ulrich Barnhoefer, Wei H. Yao and Wei Chen, Jun. 24, 2008, (10) pending U.S. patent application Ser. No. 12,145,292, entitled "Error Metric Associated With Backlight Adaptation," by Ulrich Barnhoefer, Wei H. Yao and Wei Chen, Jun. 24,2008, and (11) pending U.S. patent application Ser. No. 12,145,348, entitled "Management Techniques for Video Playback," by Ulrich T. Barnhoefer, Wei H. Yao and Wei Chen, Jun. 24, 2008, the contents of all of which are herein incorporated by reference.

BACKGROUND

1. Field of the Invention

The present invention relates to techniques for dynamically adapting backlighting for displays. More specifically, the present invention relates to circuits and methods for adjusting video signals and determining an intensity of a backlight on an image-by-image basis.

2. Related Art

Compact electronic displays, such as liquid crystal displays (LCDs), are increasingly popular components in a wide variety of electronic devices. For example, due to their low cost and good performance, these components are now used extensively in portable electronic devices, such as laptop computers.

Many of these LCDs are illuminated using fluorescent light sources or light emitting diodes (LEDs). For example, LCDs are often backlit by Cold Cathode Fluorescent Lamps (CCFLs) which are located above, behind, and/or beside the display. As shown in FIG. 1, which illustrates an existing display system in an electronic device, an attenuation mechanism 114 (such as a spatial light modulator) which is located between a light source 110 (such as a CCFL) and a display 116 is used to reduce an intensity of light 112 produced by the light source 110 which is incident on the display 116. However, battery life is an important design criterion in many electronic devices and, because the attenuation operation discards output light 112, this attenuation operation is energy inefficient, and hence can adversely affect battery life. Note that in LCD displays the attenuation mechanism 114 is included within the display 116.

In some electronic devices, this problem is addressed by trading off the brightness of video signals to be displayed on the display 116 with an intensity setting of the light source 110. In particular, many video images are underexposed, e.g., the peak brightness value of the video signals in these video images is less than the maximum brightness value allowed when the video signals are encoded. This underexposure can occur when a camera is panned during generation or encoding of the video images. While the peak brightness of the initial video image is set correctly (e.g., the initial video image is not underexposed), camera angle changes may cause the peak brightness value in subsequent video images to be reduced. Consequently, some electronic devices scale the peak brightness values in video images (such that the video images are no longer underexposed) and reduce the intensity setting of the light source 110, thereby reducing energy consumption and extending battery life.

Unfortunately, it is often difficult to reliably determine the brightness of video images, and thus it is difficult to determine the scaling using existing techniques. This is because many video images are encoded with black bars, e.g., non-picture portions of the video images. These non-picture portions complicate the analysis of the brightness of the video images, and therefore can create problems when determining the trade-off between the brightness of the video signals and the intensity setting of the light source 110. Moreover, these non-picture portions can also produce visual artifacts, which can degrade the overall user experience when using the electronic device.

Hence what is needed is a method and an apparatus that facilitates determining the intensity setting of a light source and which reduces perceived visual artifacts without the above-described problems.

SUMMARY

One embodiment of the present invention provides a system that includes one or more integrated circuits. During operation of the system, an interface in the one or more integrated circuits receives video signals associated with a video image and a brightness setting of a light source which illuminates a display that displays the video image. Next, an extraction circuit, which is electrically coupled to the input interface, calculates a brightness metric associated with the video image based on the received video signals. Then, an analysis circuit, electrically coupled to the extraction circuit, analyzes the brightness metric to identify one or more subsets of the video image, and an intensity circuit, electrically coupled to the analysis circuit, determines an intensity setting of the light source based on the brightness setting and a first portion of the brightness metric associated with one of the subsets of the video image. Note that this subset of the video image includes spatially varying visual information in the video image. Moreover, an output interface, electrically coupled to the intensity circuit, outputs the intensity setting of the light source.

In some embodiments, the one or more integrated circuits further include a scaling circuit electrically coupled to the input interface and the analysis circuit. During operation of the system, the scaling circuit scales video signals associated with the subset of the video image based on a mapping function. This mapping function is based on the first portion of the brightness metric. Moreover, the output interface is electrically coupled to the scaling circuit and outputs modified video signals, which include the scaled video signals associated with the subset of the video image.

Note that there may be a distortion metric associated with the mapping function, and the intensity setting of the light source may be based on the distortion metric. In some embodiments, the scaling is based on a dynamic range of a mechanism that attenuates coupling of light from the light source to the display that displays the video image.

In some embodiments, the video image includes a frame of video.

In some embodiments, the brightness metric includes a histogram of brightness values in the video image.

In some embodiments, the subset of the video image excludes a black bar and/or one or more lines, where the black bar and/or the one or more lines are associated with encoding of the video image. Note that the black bar and/or the one or more lines may be included in another subset of the video image, which includes the remainder of the video image which is not included in the subset of the video image. Moreover, the black bar and/or the one or more lines may be identified based on a second portion of the brightness metric associated with the other subset of the video image. For example, the brightness metric may include the histogram of brightness values in the video image, and brightness values in the second portion of the brightness metric may be less than a first predetermined value and may have a range of brightness values less than a second predetermined value.

In some embodiments, a subtitle is superimposed on at least a subset of the non-picture portion. Moreover, the scaling circuit (or an adjustment circuit) may scale the brightness of pixels corresponding to a remainder of the non-picture portion of the video image to have a new brightness value that is greater than an initial brightness value of the non-picture portion to reduce user-perceived changes in the video image associated with backlighting of the display that displays the video image. Note that the remainder of the non-picture portion may exclude the subset of the non-picture portion.

In some embodiments, the subtitle is dynamically generated and is associated with the video image. Moreover, the system may blend the subtitle with an initial video image to produce the video image.

In some embodiments, the pixels corresponding to the remainder of the non-picture portion are identified based on brightness values in the non-picture portion of the video image that are less than a threshold value. Moreover, the threshold value may be associated with the subtitle. Additionally, in some embodiments the system is configured to identify the subtitle and is configured to determine the threshold value (for example, based on the brightness metric).

In some embodiments, the video image is included in a sequence of video images, where the intensity setting is determined on an image-by-image basis in the sequence of video images.

In some embodiments, the one or more integrated circuits further include a filter electrically coupled to the intensity circuit and the output interface. During operation of the system, the filter filters a change in intensity settings of the light source between adjacent video images in the sequence of video images. For example, the filter may include a low-pass filter. Moreover, in some embodiments the filter filters the change in the intensity settings if the change is less than a third predetermined value.

In some embodiments, the one or more integrated circuits further include an adjustment circuit electrically coupled to the analysis circuit. During operation of the system, the adjustment circuit adjusts a brightness of the other subset of the video image. Note that a new brightness of the other subset of the video image provides headroom to attenuate noise associated with displaying the other subset of the video image. Moreover, the output interface is electrically coupled to the adjustment circuit and outputs modified video signals, which include the new brightness of the other subset of the video image.

In some embodiments, the adjustment of the brightness increases the brightness of the other subset of the video image by at least 1 candela per square meter.

In some embodiments, the adjustment of the brightness is based on the dynamic range of the mechanism that attenuates coupling of light from the light source to the display that displays the video image.

In some embodiments, the one or more integrated circuits further include a delay mechanism (such as a buffer) electrically coupled to the intensity circuit and/or the analysis circuit. During operation of the system, the delay mechanism synchronizes the intensity setting of the light source with a current video image to be displayed.

In some embodiments, the determined intensity setting of the light source reduces power consumption of the light source.

In some embodiments, the light source includes a light emitting diode (LED) and/or a fluorescent lamp.

Another embodiment provides a method for determining an intensity of the light source, which may be performed by a system. During operation, this system calculates the brightness metric associated with the video image. Next, the system identifies the subset of the video image based on the brightness metric. Then, the system determines the intensity setting of the light source based on the first portion of the brightness metric associated with the subset of the video image.

Another embodiment provides another method for determining the intensity of the light source, which may be performed by a system. During operation, this system calculates a histogram of brightness values associated with the video image. Next, the system identifies a picture portion of the video image based on the histogram. Then, the system determines the intensity setting of the light source based on a portion of the histogram associated with the picture portion of the video image.

Another embodiment provides a method for adjusting a brightness of the other subset of a video image, which may be performed by a system. During operation, this system calculates the brightness metric associated with the video image. Next, the system identifies the subset of the video image and the other subset of the video image based on the brightness metric. Then, the system adjusts the brightness of the other subset of the video image, where the new brightness of the second subset of the video image provides headroom to attenuate noise associated with displaying the other subset of the video image.

Another embodiment provides a method for scaling a brightness of a non-picture portion of the video image, which may be performed by a system. During operation, this system receives the video image that, when displayed, includes a picture portion and the non-picture portion, where the non-picture portion has a first brightness value. Next, the system scales the non-picture portion to have a second brightness value (e.g., the new brightness value) that is greater than the first brightness value to reduce user-perceived changes in the video image associated with backlighting of the display that displays the video image.

Another embodiment provides a method for synchronizing the intensity setting of the light source and the current video image to be displayed, which may be performed by a system. During operation, this system receives the sequence of video images and/or the brightness setting of the light source that illuminates the display that displays the video images. Next, the system determines the intensity setting of the light source on an image-by-image basis for the sequence of video images, where the intensity of the given video image is based on the brightness setting and/or brightness information contained in the video signals associated with the given video image. Then, the system synchronizes the intensity setting of the light source with the current video image to be displayed.

Another embodiment provides another method for determining the intensity setting of the light source, which may be performed by a system. During operation, this system calculates the brightness metric associated with the given video image in the sequence of video images. Next, the system identifies the subset of the given video image based on the brightness metric. Then, the system determines the intensity setting of the light source based on the first portion of the brightness metric associated with the subset of the given video image. Moreover, the system filters the change in the intensity setting of the light source relative to a previous intensity setting associated with at least a previous video image in the sequence of video images if the change is less than the first predetermined value.

Another embodiment provides another method for determining the intensity setting of the light source, which may be performed by a system. During operation, this system receives the sequence of video images, where the given video image, when displayed, includes a picture portion and a non-picture portion. Note that the picture portion has a histogram of brightness values. Next, the system determines the intensity setting of the light source on an image-by-image basis based on the histogram. Then, the system selectively filters changes in the intensity setting of the light source, where the selective filtering is based on the magnitude of a given change in the intensity setting from the previous video image to the current video image.

Another embodiment provides yet another method for adjusting a brightness of a portion of a video image, which may be performed by a system. During operation, this system receives a video image, that when displayed, includes a picture portion, a non-picture portion, and a subtitle which is superimposed on at least a subset of the non-picture portion. Note that the non-picture portion has an initial brightness value. Next, the system scales the brightness of pixels corresponding to the remainder of the non-picture portion of the video image to have a new brightness value that is greater than the initial brightness value to reduce user-perceived changes in the video image associated with backlighting of a display that displays the video image. Moreover, note that the remainder of the non-picture portion excludes the subset of the non-picture portion.

Another embodiment provides the one or more integrated circuits associated with one or more of the above-described embodiments.

Another embodiment provides a portable device. This device may include the display, the light source and the attenuation mechanism. Moreover, the portable device may include the one or more integrated circuits.

Another embodiment provides one or more additional integrated circuit. During operation, one or more of these additional integrated circuits may perform at least some of the operations in the above-described methods. In some embodiments, the one or more additional integrated circuits are included in the portable device.

Another embodiment provides a computer-program product for use in conjunction with a system. This computer-program product may include instructions corresponding to at least some of the operations in the above-described methods.

Another embodiment provides a computer system. This computer system may execute instructions corresponding to at least some of the operations in the above-described methods. Moreover, these instructions may include high-level code in a program module and/or low-level code that is executed by a processor in the computer system.

BRIEF DESCRIPTION OF THE FIGURES

Note that like reference numerals refer to corresponding parts throughout the drawings.

DETAILED DESCRIPTION

Figure 1:
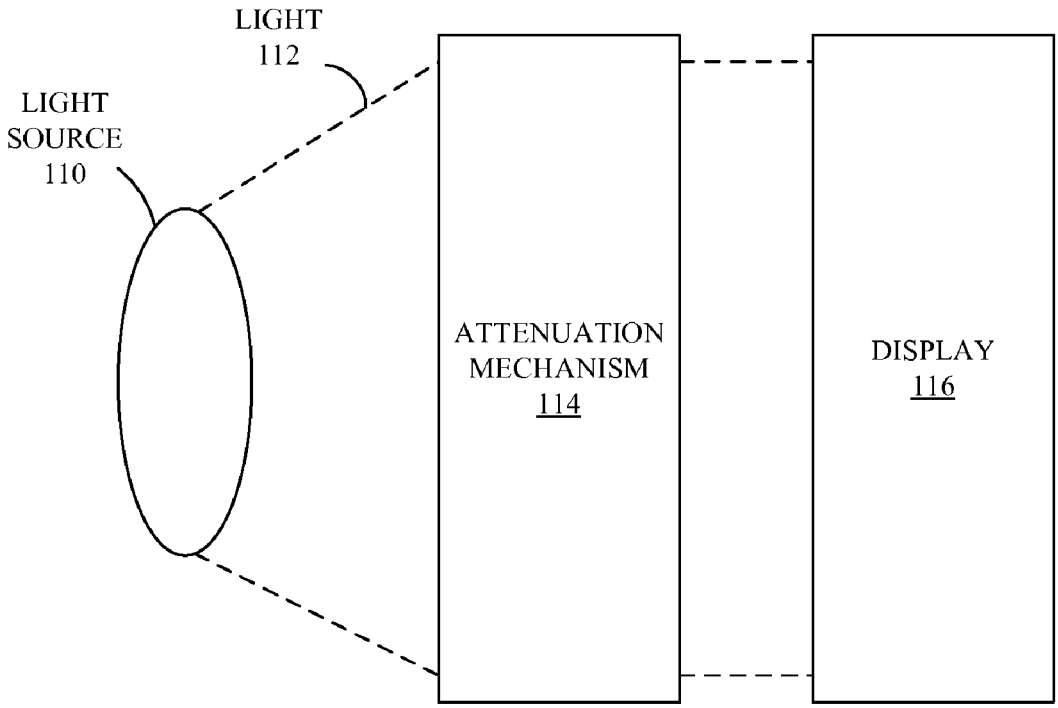
FIG. 1 (PRIOR ART)
FIG. 1 is a block diagram illustrating a display system.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Embodiments of hardware, software, and/or processes for using the hardware and/or software are described. Note that hardware may include a circuit, a portable device, a system (such as a computer system), and software may include a computer-program product for use with the computer system. Moreover, in some embodiments the portable device and/or the system include one or more of the circuits.

These circuits, devices, systems, computer-program products, and/or processes may be used to determine an intensity of a light source, such as a light emitting diode (LED) and/or a fluorescent lamp. In particular, this light source may be used to backlight an LCD display in the portable device and/or the system, which displays video images (such as frames of video) in a sequence of video images. By determining a brightness metric (for example, a histogram of brightness values) of at least a portion of the one or more of the video images, the intensity of the light source may be determined. Moreover, in some embodiments video signals (such as the brightness values) associated with at least the portion of the one or more video images are scaled based on a mapping function which is determined from the brightness metric.

In some embodiments, the brightness metric is analyzed to identify a non-picture portion of a given video image and/or a picture portion of the given video image, e.g., a subset of the given video image that includes spatially varying visual information. For example, video images are often encoded with one or more black lines and/or black bars (which may or more not be horizontal) that at least partially surround the picture portion of the video images. Note that this problem typically occurs with user-supplied content, such as that found on networks such as the Internet. By identifying the picture portion of the given video image, the intensity of the light source may be correctly determined on an image-by-image basis. Thus, the intensity setting of the light source may be varied stepwise (as a function of time) from image to image in a sequence of video images.

Moreover, in some embodiments the non-picture portion of the given video image can lead to visual artifacts. For example, in portable devices and systems that include the attenuation mechanism 114, the non-picture portions are often assigned a minimum brightness value, such as black. Unfortunately, this brightness value allows users to perceive noise associated with pulsing of the light source 110. Consequently, in some embodiments the brightness of the non-picture portion of the given video image is scaled to a new brightness value that provides headroom to attenuate or reduce perception of this noise.

In some embodiments, there are large changes in brightness in adjacent video images in the sequence of video images, such as the brightness changes associated with the transition from one scene to the next in a movie. To prevent a filter from inadvertently smoothing out such changes, filtering of changes to the intensity of the light source for the given video image may be selectively disabled. Moreover, in some embodiments a buffer is used to synchronize the intensity setting of the light source with a current video image to be displayed.

By determining the intensity setting of the light source on an image-by-image basis, these techniques facilitate a reduction in the power consumption of the light source. In an exemplary embodiment, the power savings associated with the light source can be between 15-50%. This reduction provides additional degrees of freedom in the design of portable devices and/or systems. For example, using these techniques portable devices may: have a smaller battery, offer longer playback time, and/or include a larger display.

These techniques may be used in a wide variety of portable devices and/or systems. For example, the portable device and/or the system may include: a personal computer, a laptop computer, a cellular telephone, a personal digital assistant, an MP3 player, and/or another device that includes a backlit display.

Techniques to determine an intensity of the light source in accordance with embodiments of the invention are now described. In the embodiments that follow, a histogram of brightness values in a given image is used as an illustration of a brightness metric from which the intensity of the light source is determined. However, in other embodiments one or more additional brightness metrics are used, either separately or in conjunction, with the histogram.

Figure 2A:
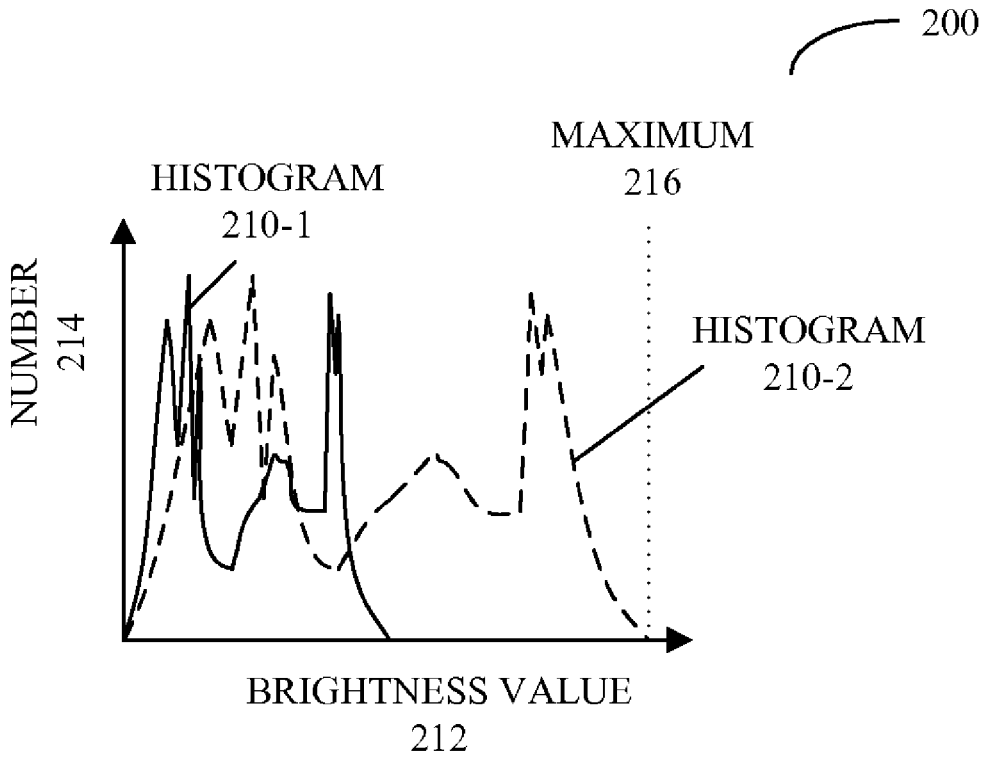
FIG. 2A is a graph illustrating histograms of brightness values in a video image in accordance with an embodiment of the present invention.

FIG. 2A presents a graph 200 illustrating an embodiment of histograms 210 of brightness values, plotted as a number 214 of counts as a function of brightness value 212, in a video image (such as a frame of video). Note that the peak brightness value in an initial histogram 210-1 is less than a maximum 216 brightness value that is allowed when encoding the video image. For example, the peak value may be associated with a grayscale level of 202 and the maximum 216 may be associated with a grayscale level of 255. If a gamma correction of a display that displays the video image is 2.2, the brightness associated with the peak value is around 60% of the maximum 216. Consequently, the video image is underexposed. This common occurrence often results during panning. In particular, while an initial video image in a sequence of video images, for example, associated with a scene in a movie, has a correct exposure, as the camera is panned the subsequent video images may be underexposed.

In display systems, such as those that include an LCD display (and more generally, those that include the attenuation mechanism 114 in FIG. 1), underexposed video images waste power because the light output by the light source 110 (FIG. 1) that illuminates the display 116 (FIG. 1) will be reduced by the attenuation mechanism 114 (FIG. 1).

However, this provides an opportunity to save power while maintaining the overall image quality. In particular, the brightness values in at least a portion of the video image may be scaled up to the maximum 216 (for example, by redefining the grayscale levels) or even beyond the maximum 216 (as described further below). This is illustrated by histogram 210-2 in FIG. 2A. Note that the intensity setting of the light source is then reduced (for example, by changing the duty cycle or the current to an LED) such that the product of the peak value in the histogram 210-2 and the intensity setting is approximately the same as before the scaling. In an embodiment where the video image is initially 40% underexposed, this technique offers the ability to reduce power consumption associated with the light source by approximately 40%, i.e., significant power savings.

Figure 2B:
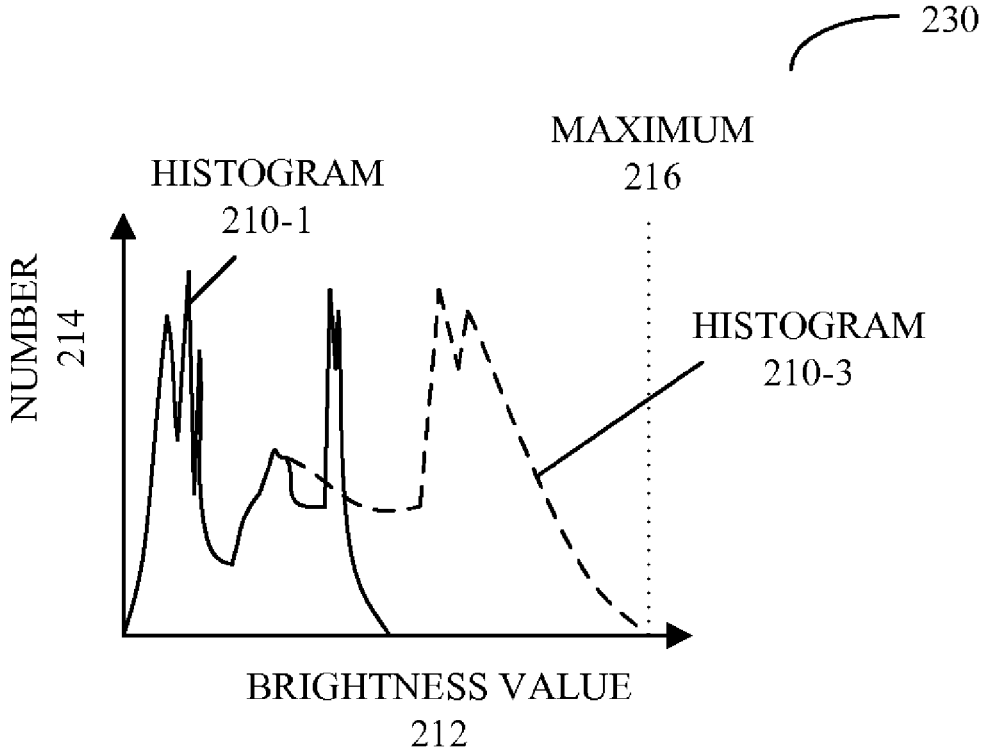
FIG. 2B is a graph illustrating histograms of brightness values in a video image in accordance with an embodiment of the present invention.

While the preceding example scaled the brightness of the entire video image, in some embodiments the scaling may be applied to a portion of the video image. For example, as shown in FIG. 2B, which presents a graph 230 illustrating an embodiment of histograms 210 of brightness values in the video image, brightness values in the video image associated with a portion of the histogram 210-1 may be scaled to produce histogram 210-3. Note that scaling of the brightness values associated with the portion of the histogram 210-1 may be facilitated by tracking a location (such as a line number or a pixel) associated with a given contribution to the histogram 210-1. In general, the portion of the video image (and, thus, the portion of the histogram) that is scaled may be based on the distribution of values in the histogram, such as: a weighted average, one or more moments of the distribution, and/or the peak value.

Moreover, in some embodiments this scaling may be non-linear and may be based on a mapping function (which is described further below with reference to FIG. 3). For example, brightness values in the video image associated with a portion of the histogram may be scaled to a value larger than the maximum 216, which facilitates scaling for video images that are saturated (e.g., video images that initially have a histogram of brightness values with peak values equal to the maximum 216). Then, a non-linear compression may be applied to ensure that the brightness values in the video image (and, thus, in the histogram) are less than the maximum 216.

Note that while FIGS. 2A and 2B illustrate scaling of the brightness values for a given video image, these techniques may be applied to a sequence of video images. In some embodiments, the scaling and the intensity of the light source are determined on an image-by-image basis from a histogram of brightness values for a given video image in the sequence of video images. In an exemplary embodiment, the scaling is first determined based on the histogram for a given video image and then the intensity setting is determined based on the scaling (for example, using a mapping function, such as that described below with reference to FIG. 3). In other embodiments, the intensity setting is first determined based on the histogram for the given video image, and then the scaling is determined based on the intensity setting for this video image.

Figure 3:
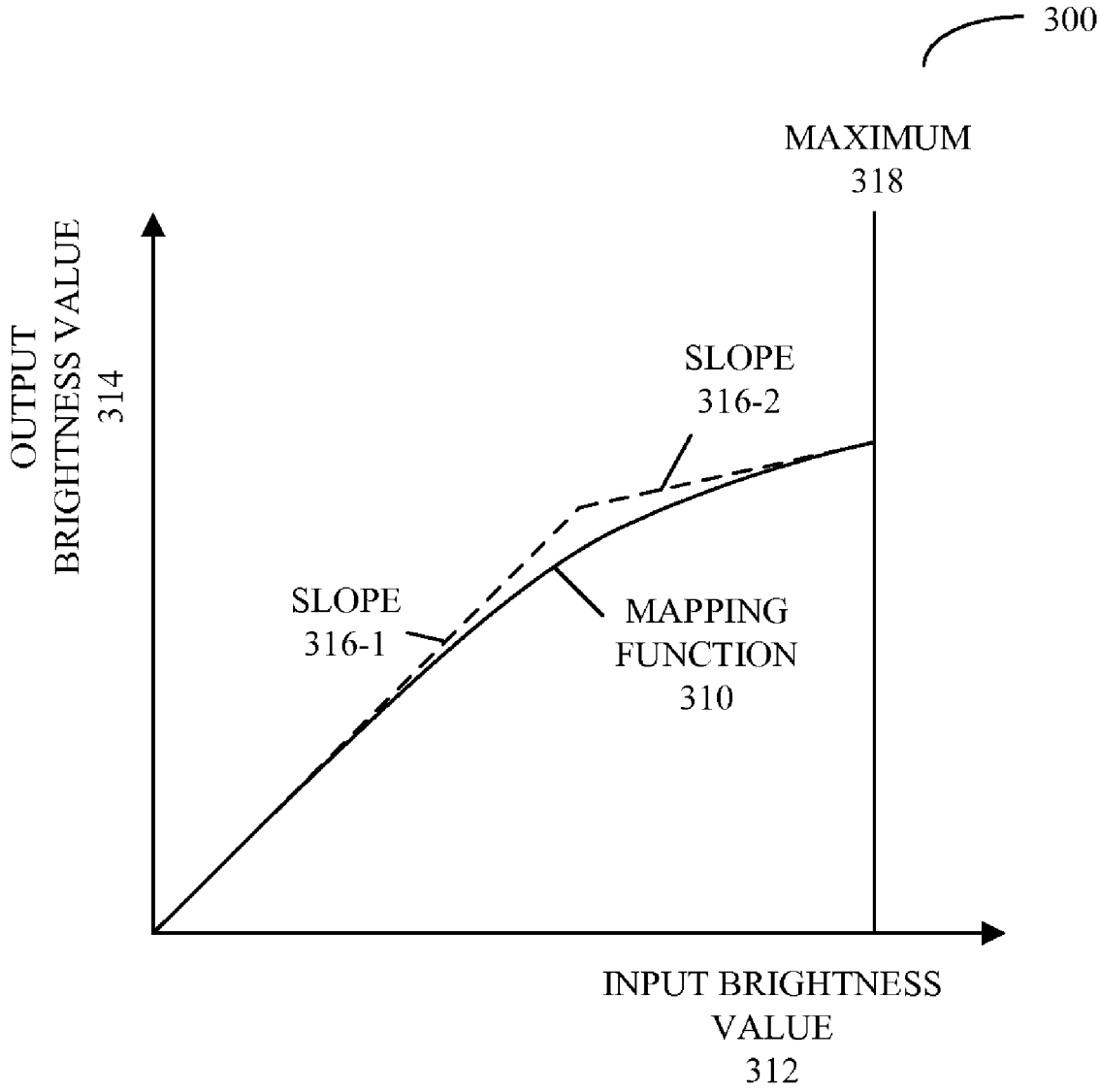
FIG. 3 is a graph illustrating a mapping function in accordance with an embodiment of the present invention.

FIG. 3 presents a graph 300 illustrating an embodiment of a mapping function 310, which performs a mapping from an input brightness value 312 (up to a maximum 318 brightness value) to an output brightness value 314. In general, the mapping function 310 includes a linear portion associated with slope 316-1 and a non-linear portion associated with slope 316-2. Note that in general the non-linear portion(s) may be at arbitrary position(s) in the mapping function 310. In an exemplary embodiment where the video image is underexposed, the slope 316-1 is greater than one and the slope 316-2 is zero.

Note that for a given mapping function, which may be determined from the histogram of the brightness values for at least a portion of given video image, there may be an associated distortion metric. For example, the mapping function 310 may implement a non-linear scaling of brightness values in a portion of a video image and the distortion metric may be a percentage of the video image that is distorted by this mapping operation.

In some embodiments, the intensity setting of the light source for a given video image is based, at least in part, on the associated distortion metric. For example, the mapping function 310 may be determined from the histogram of the brightness values for at least a portion of a given video image such that the associated distortion metric (such as a percentage distortion in the given video image) is less than a pre-determine value, such as 10%. Then, the intensity setting of the light source may be determined from the scaling of the histogram associated with the mapping function 310. Note that in some embodiments the scaling (and, thus, the intensity setting) is based, at least in part, on a dynamic range of the attenuation mechanism 114 (FIG. 1), such as a number of grayscale levels. Moreover, note that in some embodiments the scaling is applied to grayscale values or to brightness values after including the effect of the gamma correction associated with the display.

One or more circuits or sub-circuits in a circuit, which may be used to determine the intensity setting of the given video image in a sequence of video images, in accordance with embodiments of the invention are now described. These circuits or sub-circuits may be included on one or more integrated circuits. Moreover, the one or more integrated circuits may be included in devices (such as a portable device that includes a display system) and/or a system (such as a computer system).

Figure 4A:
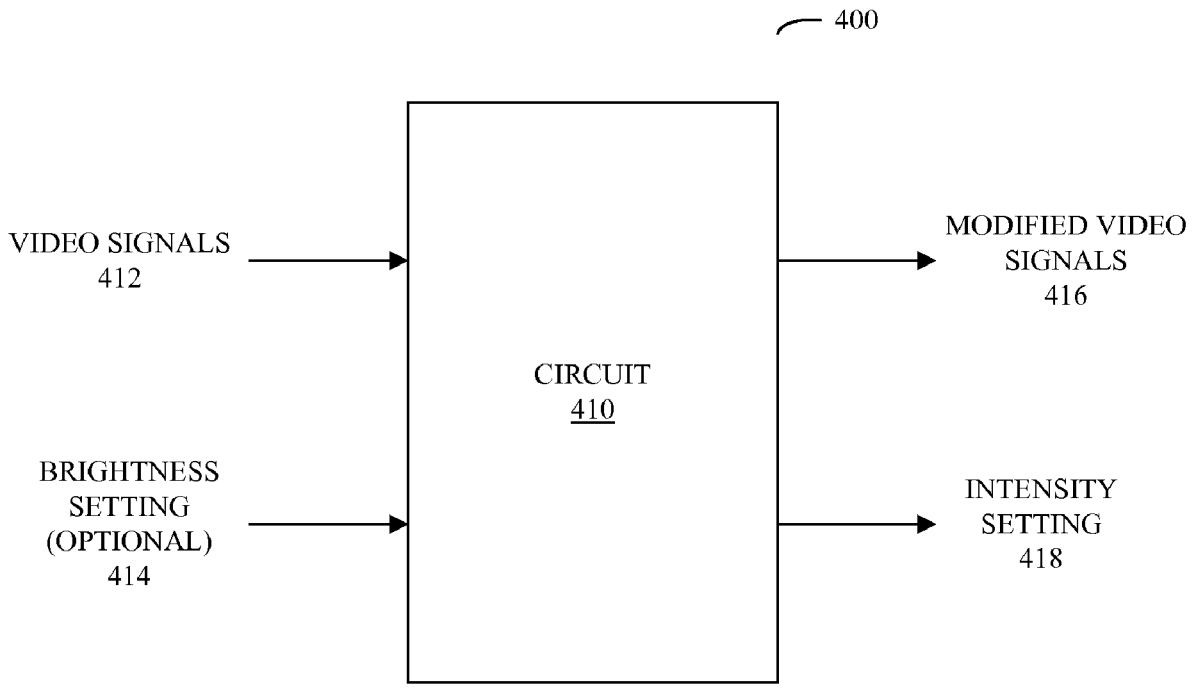
FIG. 4A is a block diagram illustrating a circuit in accordance with an embodiment of the present invention.

FIG. 4A presents a block diagram illustrating an embodiment 400 of a circuit 410. This circuit receives video signals 412 (such as RGB) associated with a given video image in a sequence of video images, and outputs modified video signals 416 and an intensity setting 418 of the light source for the given video image. Note that the modified video signals 416 may include scaled brightness values for at least a portion of the given video image. Moreover, in some embodiments the circuit 410 receives information associated with video images in the sequence of video images in a different format, such as YUV.

In some embodiments, the circuit 410 receives an optional brightness setting 414. For example, the brightness setting 414 may be a user-supplied brightness setting for the light source (such as 50%). In these embodiments, the intensity setting 418 may be a product of the brightness setting 414 and an intensity setting (such as a scale value) that is determined based on the histogram of brightness values of the given video image and/or the scaling of histogram of brightness values of the given video image. Moreover, if the intensity setting 418 is reduced by a factor corresponding to the brightness setting, the scaling of the histogram of brightness values (e.g., the mapping function 310 in FIG. 3) may be adjusted by the inverse of the factor such that the product of the peak value in the histogram and the intensity setting 418 is approximately constant. This compensation based on the brightness setting 414 may prevent visual artifacts from being introduced when the given video image is displayed.

Moreover, in some embodiments the determination of the intensity setting is based on one or more additional inputs, including: an acceptable distortion metric, a power-savings target, the gamma correction (and more generally, a saturation boost factor associated with the display), a contrast improvement factor, a portion of the video image (and, thus, a portion of the histogram of brightness values) to be scaled, and/or a filtering time constant.

Figure 4B:
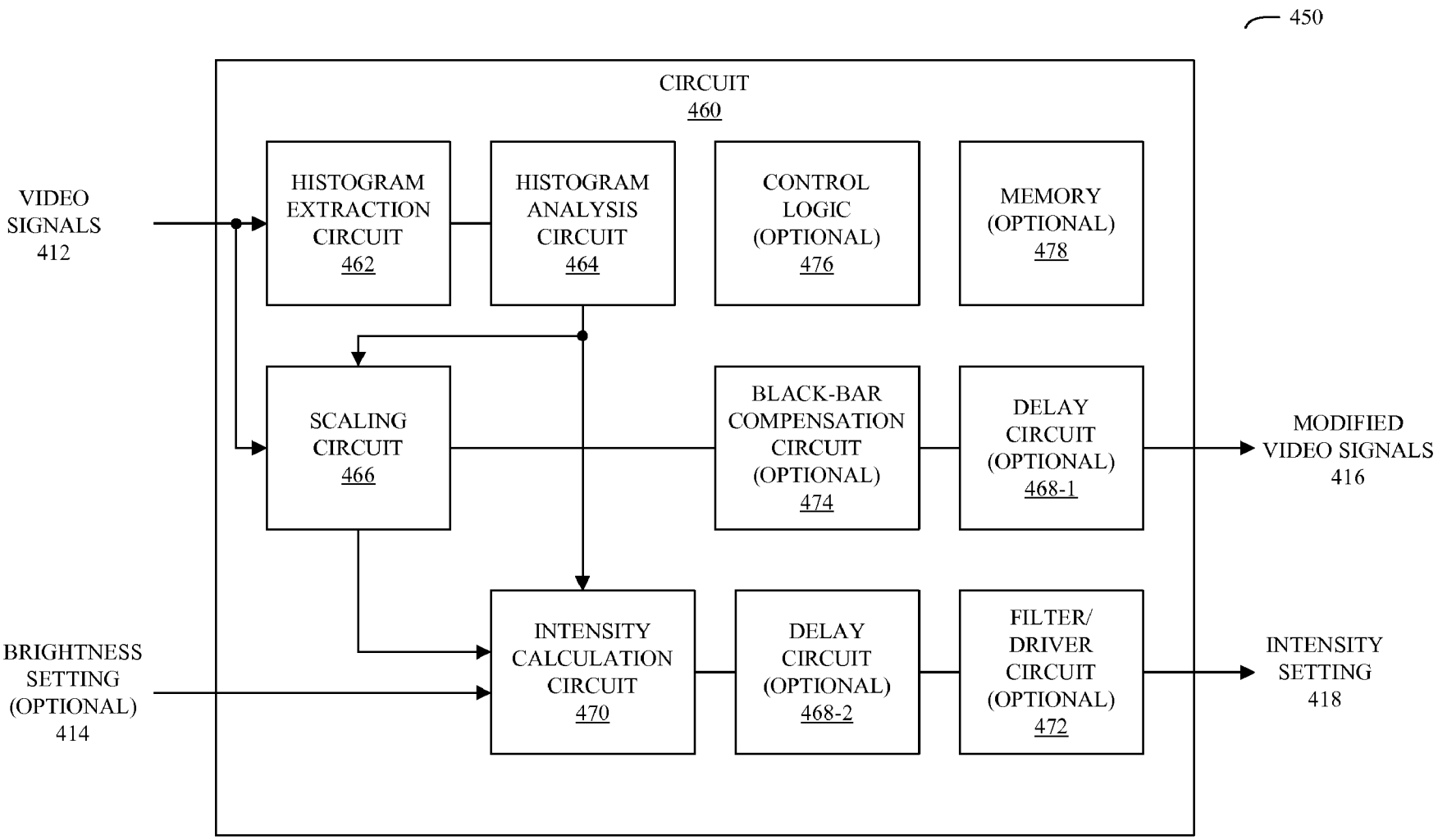
FIG. 4B is a block diagram illustrating a circuit in accordance with an embodiment of the present invention.

FIG. 4B presents a block diagram illustrating an embodiment of a circuit 450. This circuit includes an interface (not shown) that receives the video signals 412 associated with the given video image, which is electrically coupled to a histogram extraction circuit 462 and a scaling circuit 466. In some embodiments, the circuit 450 optionally receives the brightness setting 414.

Histogram extraction circuit 462 calculates the histogram of brightness values based on at least some of the video signals 412, e.g., based on at least a portion of the given video image. In an exemplary embodiment, the histogram is determined for the entire given video image.

This histogram is then analyzed by histogram analysis circuit 464 to identify one or more subsets of the given video image. For example, picture and/or non-picture portions of the given image may be identified based on the associated portions of the histogram of brightness values (as described further below with reference to FIGS. 5A and 5B). In general, the picture portion(s) of the given video image include spatially varying visual information, and the non-picture portion(s) include the remainder of the given video image. In some embodiments, the histogram analysis circuit 464 is used to determine a size of the picture portion of the given video image. Additionally, in some embodiments the histogram analysis circuit 464 is used to identify one or more subtitles in the non-picture portion(s) of the given video image (as described further below with reference to FIG. 5C).

Using the portion(s) of the histogram associated with the one or more subsets of the given video image, scaling circuit 466 may determine the scaling of the portion(s) of the given video image, and thus, the histogram. For example, the scaling circuit 466 may determine the mapping function 310 (FIG. 3) for the given video image, and may scale brightness values in the video signals 412 based on this mapping function. Then, scaling information may be provided to intensity calculation circuit 470, which determines the intensity setting 418 of the light source on an image-by-image basis using this information. As noted previously, in some embodiments this determination is also based on optional brightness setting 414. Moreover, an output interface (not shown) may output the modified video signals 416 and/or the intensity setting 418.

In an exemplary embodiment, the non-picture portion(s) of the given video image include one or more black lines and/or one or more black bars (henceforth referred to as black bars for simplicity). Black bars are often displayed with a minimum brightness value (such as 1.9 nits), which is associated with light leakage in a display system. Unfortunately, this minimum value does not provide sufficient headroom to allow adaptation of the displayed video image to mask pulsing of the backlight.

Consequently, in some embodiments an optional black-bar adjustment or compensation circuit 474 is used to adjust a brightness of the non-picture portion(s) of the given video image. The new brightness value of the non-picture portion(s) of the given video image provides headroom to attenuate noise associated with the displaying of the given video image, such as the noise associated with pulsing of the backlight. In particular, the display may now have inversion levels with which to suppress light leakage associated with the pulsing. Note that in some embodiments the video image includes one or more subtitles, and the brightness values of pixels in the non-picture portion(s) associated with the subtitles may be unchanged during the adjustment of the non-picture portion(s) (as discussed further below with reference to FIG. 5C). However, brightness values of pixels associated with the one or more subtitles may be scaled in the same manner as the brightness values of pixels in the picture portion of the video image.

In an exemplary embodiment, the grayscale value of the one or more black bars can be increased from 0 to 6-10 (relative to a maximum value of 255) or a brightness increase of at least 1 candela per square meter. In conjunction with the gamma correction and light leakage in a typical display system, this adjustment may increases the brightness of the one or more black bars by around a factor of 2, representing a trade-off between the brightness of the black bars and the perception of the pulsing of the backlight.

In some embodiments, the circuit 450 includes an optional filter/driver circuit 472. This circuit may be used to filter, smooth, and/or average changes in the intensity setting 418 between adjacent video images in the sequence of video images. This filtering may provide systematic under-relaxation, thereby limiting the change in the intensity setting 418 from image to image (e.g., spreading changes out over several frames). Additionally, the filtering may be used to apply advanced temporal filtering to reduce or eliminate flicker artifacts and/or to facilitate larger power reduction by masking or eliminating such artifacts. In an exemplary embodiment, the filtering implemented by the filter/driver circuit 472 includes a low-pass filter. Moreover, in an exemplary embodiment the filtering or averaging is over 2, 4, or 10 frames of video. Note that a time constant associated with the filtering may be different based on a direction of a change in the intensity setting and/or a magnitude of a change in the intensity setting.

In some embodiments, the filter/driver circuit 472 maps from a digital control value to an output current that drives an LED light source. This digital control value may have 7 or 8 bits.

Note that the filtering may be asymmetric depending on the sign of the change. In particular, if the intensity setting 418 decreases for the given video image, this may be implemented using the attenuation mechanism 114 (FIG. 1) without producing visual artifacts, at the cost of slightly higher power consumption for a few video images. However, if the intensity setting 418 increases for the given video image, visual artifacts may occur if the change in the intensity setting 418 is not filtered.

These artifacts may occur when the scaling of the video signals 412 is determined. Recall that the intensity setting 418 may be determined based on this scaling. However, when filtering is applied, the scaling may need to be modified based on the intensity setting 418 output from the filter/driver circuit 472 because there may be mismatches between the calculation of the scaling and the related determination of the intensity setting 418. Note that these mismatches may be associated with component mismatches, a lack of predictability, and/or nonlinearities. Consequently, the filtering may reduce perception of visual artifacts associated with errors in the scaling for the given video image associated with these mismatches.

Note that in some embodiments the filtering is selectively disabled if there is a large change in the intensity setting 418, such as that associated with the transition from one scene to another in a movie. For example, the filtering may be selectively disabled if the peak value in a histogram of brightness values increases by 50% between adjacent video images. This is described further below with reference to FIG. 6.

In some embodiments, the circuit 450 uses a feed-forward technique to synchronize the intensity setting 418 with the modified video signals 416 associated with a current video image that is to be displayed. For example, the circuit 450 may include one or more optional delay circuits 468 (such as memory buffers) that delay the modified video signals 416 and/or the intensity setting 418, thereby synchronizing these signals. In an exemplary embodiment, the delay is at least as long as a time interval associated with the given video image.

Note that in some embodiments the circuits 400 (FIG. 4A) and/or 450 includes fewer or additional components. For example, functions in the circuit 450 may be controlled using control logic 476, which may use information stored in optional memory 478. In some embodiments, histogram analysis circuit 464 determines the scaling and the intensity setting of the light source, which are then provided to the scaling circuit 466 and the intensity calculation circuit 470, respectively, for implementation.

Moreover, two or more components can be combined into a single component and/or a position of one or more components can be changed. In some embodiments, some or all of the functions in the circuits 400 (FIG. 4A) and/or 450 are implemented in software.

Figure 5A:
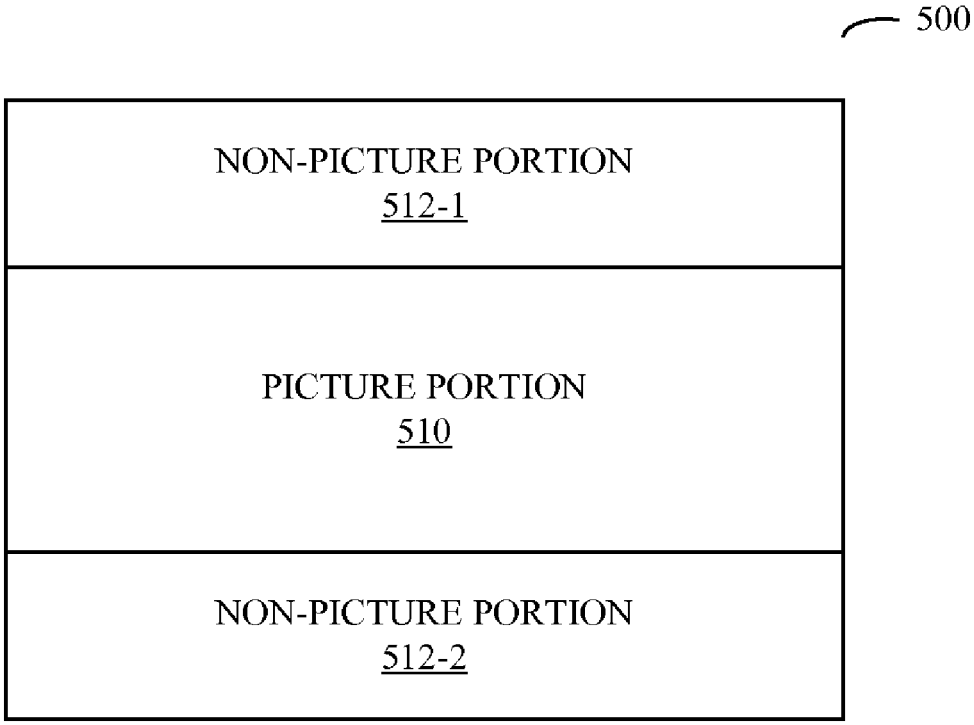
FIG. 5A is a block diagram illustrating picture and non-picture portions of a video image in accordance with an embodiment of the present invention.

Identification of the picture and non-picture portions of the given video image in accordance with embodiments of the invention are now further described. FIG. 5A presents a block diagram illustrating an embodiment of a picture portion 510 and non-picture portions 512 of a video image 500. As noted previously, the non-picture portions 512 may include one or more black lines and/or one or more black bars. However, note that the non-picture portions 512 may or may not be horizontal. For example, non-picture portions 512 may be vertical.

Figure 5B:
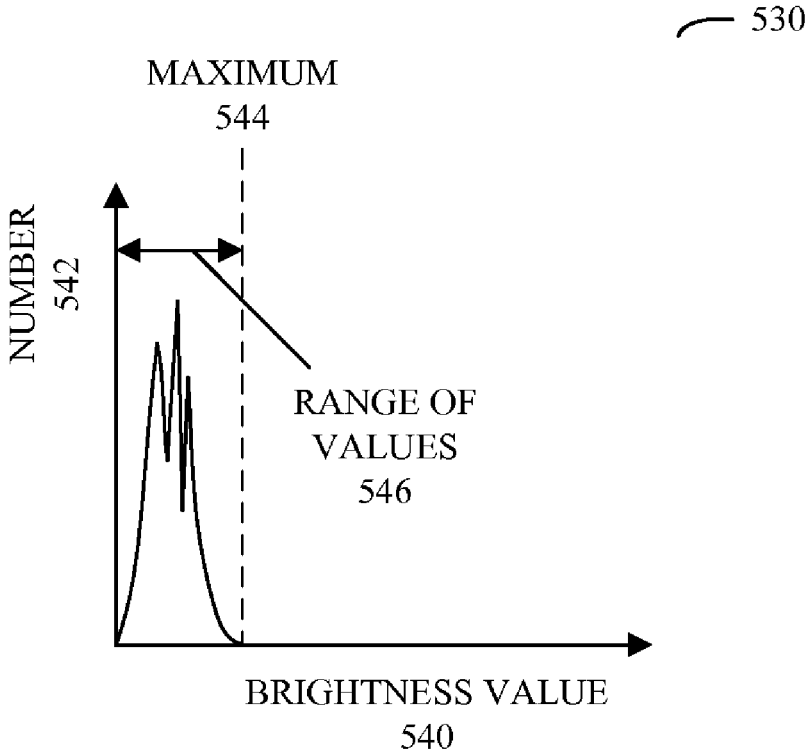
FIG. 5B is a graph illustrating a histogram of brightness values in a non-picture portion of a video image in accordance with an embodiment of the present invention.

Non-picture portions 512 of the given video image may be identified using an associated histogram of brightness values. This is shown in FIG. 5B, which presents a graph 530 illustrating an embodiment of a histogram of brightness values in a non-picture portion of a video image, plotted as a number 542 of counts as a function of brightness value 540. This histogram may have a maximum 544 brightness value that is less than a predetermined value, and a range of values 546 that is less than another predetermined value. For example, the maximum 544 may be a grayscale value of 20 or, with a gamma correction of 2.2., a brightness value of 0.37% of the maximum brightness value.

In some embodiments, one or more non-picture portions 512 of a given video image include one or more subtitles (or, more generally, overlaid text or characters). For example, a subtitle may be dynamically generated and associated with the video image. Moreover, in some embodiments a component (such as the circuit 410 in FIG. 4A) may blend the subtitle with an initial video image to produce the video image. Additionally, in some embodiments the subtitle is included in the video image that is received by the component (e.g., the subtitle is already embedded in the video image).

Figure 5C:
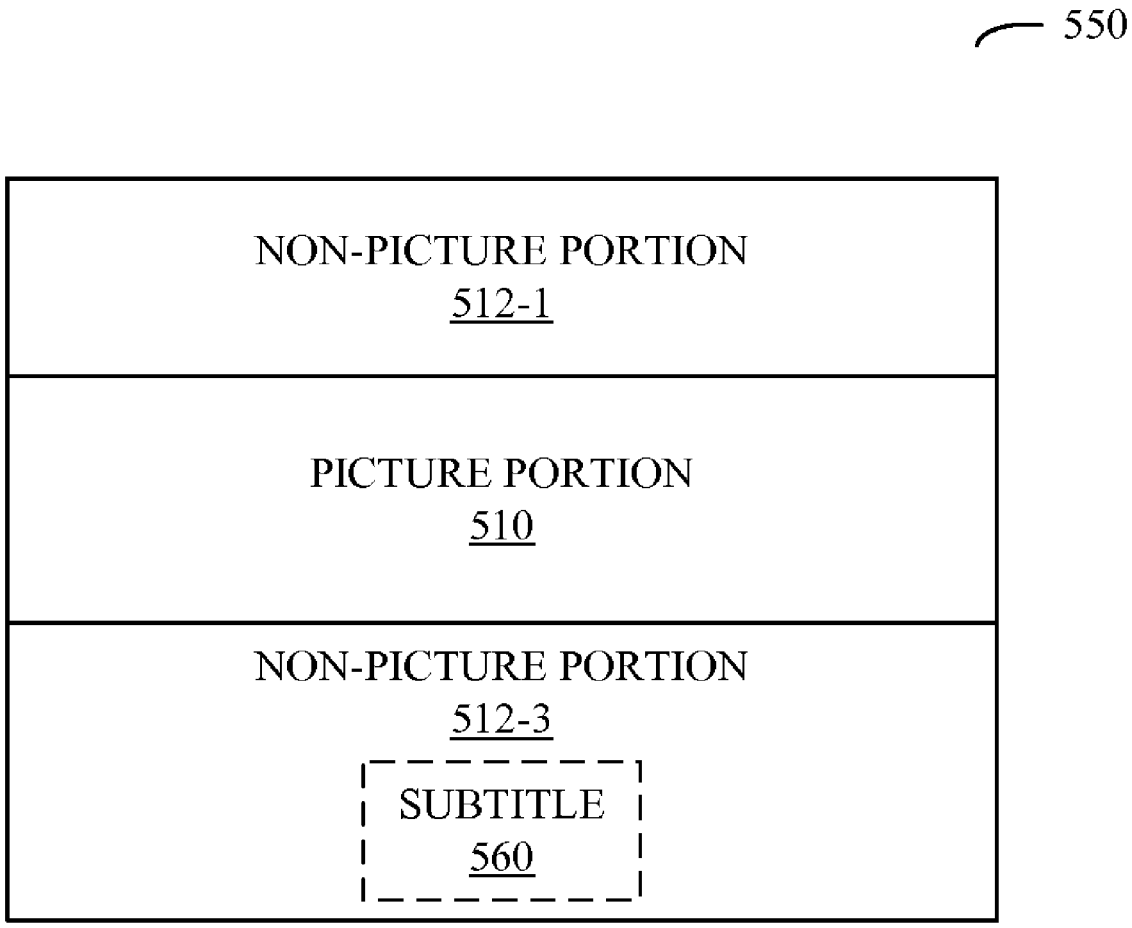
FIG. 5C is a block diagram illustrating picture and non-picture portions of a video image in accordance with an embodiment of the present invention.

FIG. 5C presents a block diagram illustrating picture portion 510 and non-picture portions 512 of a video image 550, including a subtitle 560 in non-picture portion 512-3. When the brightness of the non-picture portion is adjusted, the brightness of pixels corresponding to the subtitle 560 may be unchanged, thereby preserving the intended content of the subtitle. In particular, if the subtitle 560 has a brightness greater than a threshold or a minimum value, then the corresponding pixels in the video image already have sufficient headroom to attenuate the noise associated with the displaying of the given video image, such as the noise associated with pulsing of the backlight. Consequently, the brightness of these pixels may be left unchanged or may be modified (as needed) in the same way as pixels in the picture portion 510. However, note that brightness values of pixels associated with the subtitle 560 may be scaled in the same manner as the brightness values of pixels in the picture portion 510 of the video image.

In some embodiments, pixels corresponding to a remainder of the non-picture portion 512-3 are identified based on brightness values in the non-picture portion of the video image that are less than the threshold value. In a temporal data stream corresponding to the video image, these pixels may be overwritten, pixel by pixel, to adjust their brightness values.

Moreover, the threshold value may be associated with the subtitle 560. For example, if the subtitle 560 is dynamically generated and/or blended with the initial video image, brightness and/or color content associated with the subtitle 560 may be known. Consequently, the threshold may be equal to or related to the brightness values of the pixels in the subtitle 560. In an exemplary embodiment, a symbol in the subtitle 560 may have two brightness values, and the threshold may be the lower of the two. Alternatively or additionally, in some embodiments the component is configured to identify the subtitle 560 and is configured to determine the threshold value (for example, based on the histogram of brightness values). For example, the threshold may be a grayscale level of 180 out of a maximum of 255. Note that in some embodiments rather than a brightness threshold there may be three thresholds associated with color content (or color components) in the video image.

Figure 6:
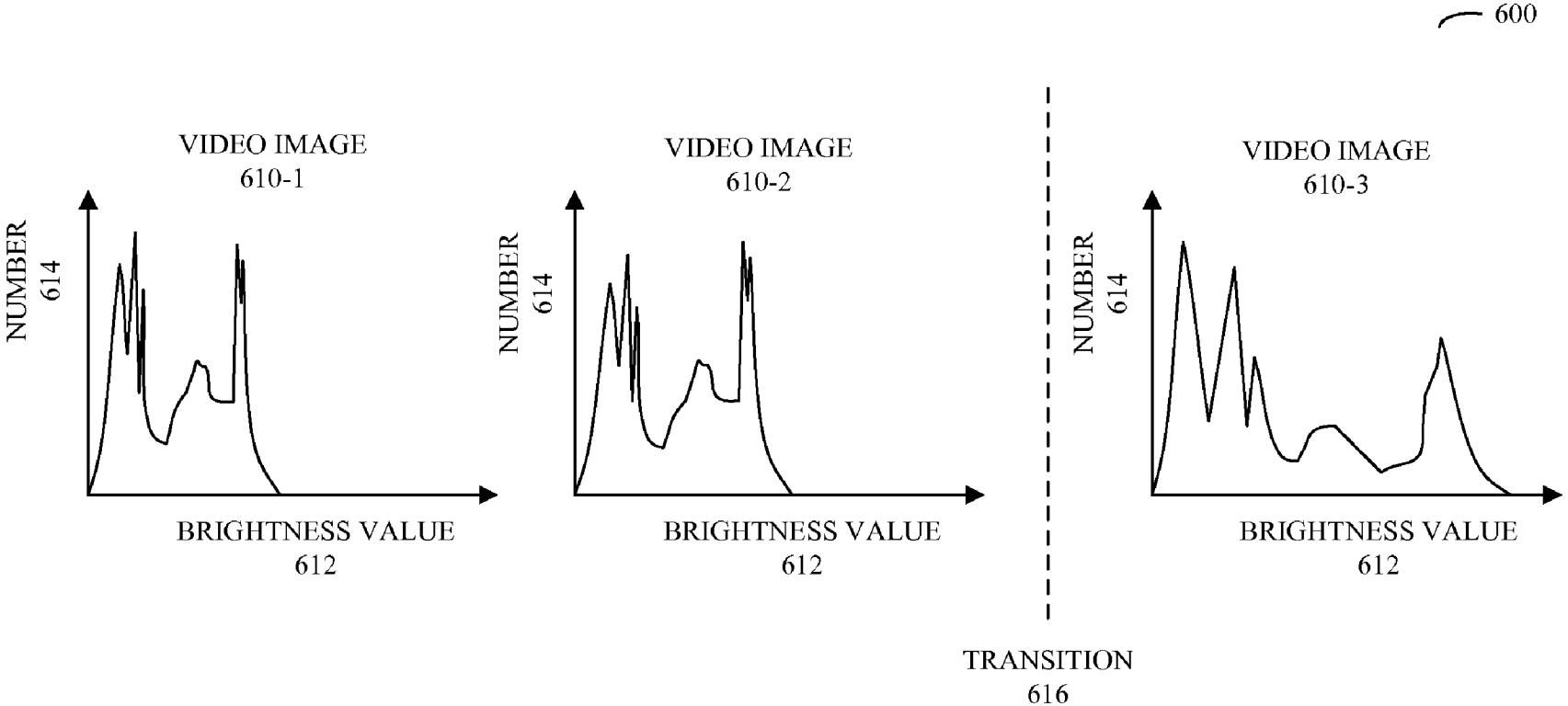
FIG. 6 is a sequence of graphs illustrating histograms of brightness values for a sequence of video images in accordance with an embodiment of the present invention.

Filtering of the intensity setting 418 (FIGS. 4A and 4B) in a sequence of video images in accordance with embodiments of the invention is now further described. FIG. 6 presents a sequence of graphs 600 illustrating an embodiment of histograms 610 of brightness values, plotted as a number 614 of counts as a function of brightness value 612, for a received sequence of video images (prior to any scaling of the video signals). Transition 616 indicates the large change in the peak value of the brightness in histogram 610-3 relative to histogram 610-2. As described previously, in some embodiments the filtering of the intensity setting 418 (FIGS. 4A and 4B) is disabled when such a large change occurs, thereby allowing the full brightness change to be displayed in the current video image.

Figure 7A:
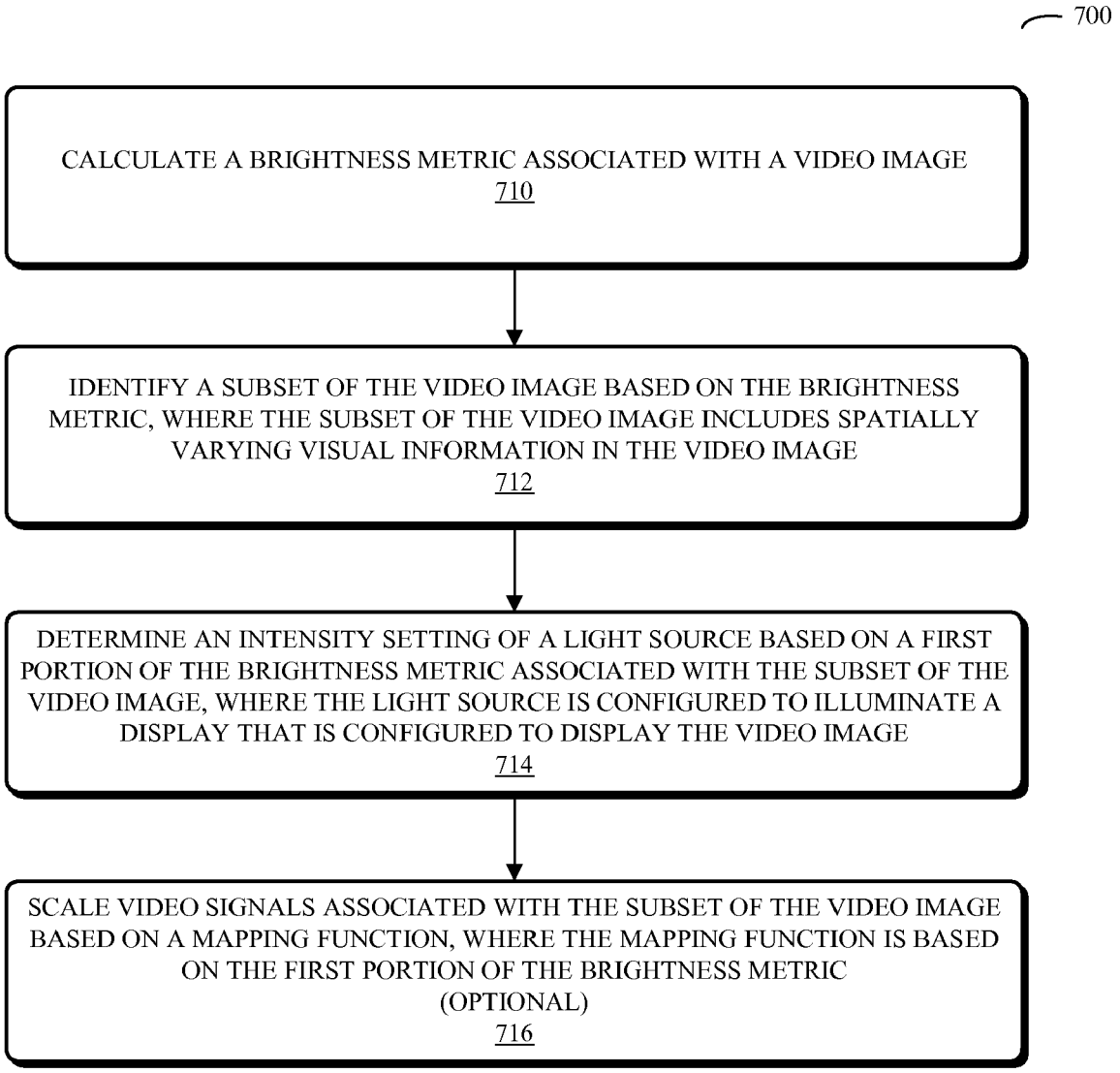
FIG. 7A is a flowchart illustrating a process for determining an intensity of a light source in accordance with an embodiment of the present invention.

Processes associated with the above-described techniques in accordance with embodiments of the invention are now described. FIG. 7A presents a flowchart illustrating a process 700 for determining an intensity of the light source, which may be performed by a system. During operation, this system calculates the brightness metric associated with the video image (710). Next, the system identifies the subset of the video image based on the brightness metric (712), where the subset of the video image includes spatially varying visual information in the video image.

Then, the system determines the intensity setting of the light source based on the first portion of the brightness metric associated with the subset of the video image (714), where the light source is configured to illuminate the display that is configured to display the video image. Moreover, in some embodiments the system optionally scales video signals associated with the subset of the video image based on a mapping function (716), where the mapping function is based on the first portion of the brightness metric.

In an exemplary embodiment, the brightness metric includes a histogram of brightness values associated with the video image, and the subset of the video image includes a picture portion of the video image. Consequently, the first portion of the brightness metric may include the portion of the histogram associated with the picture portion of the video image.

Figure 7B:
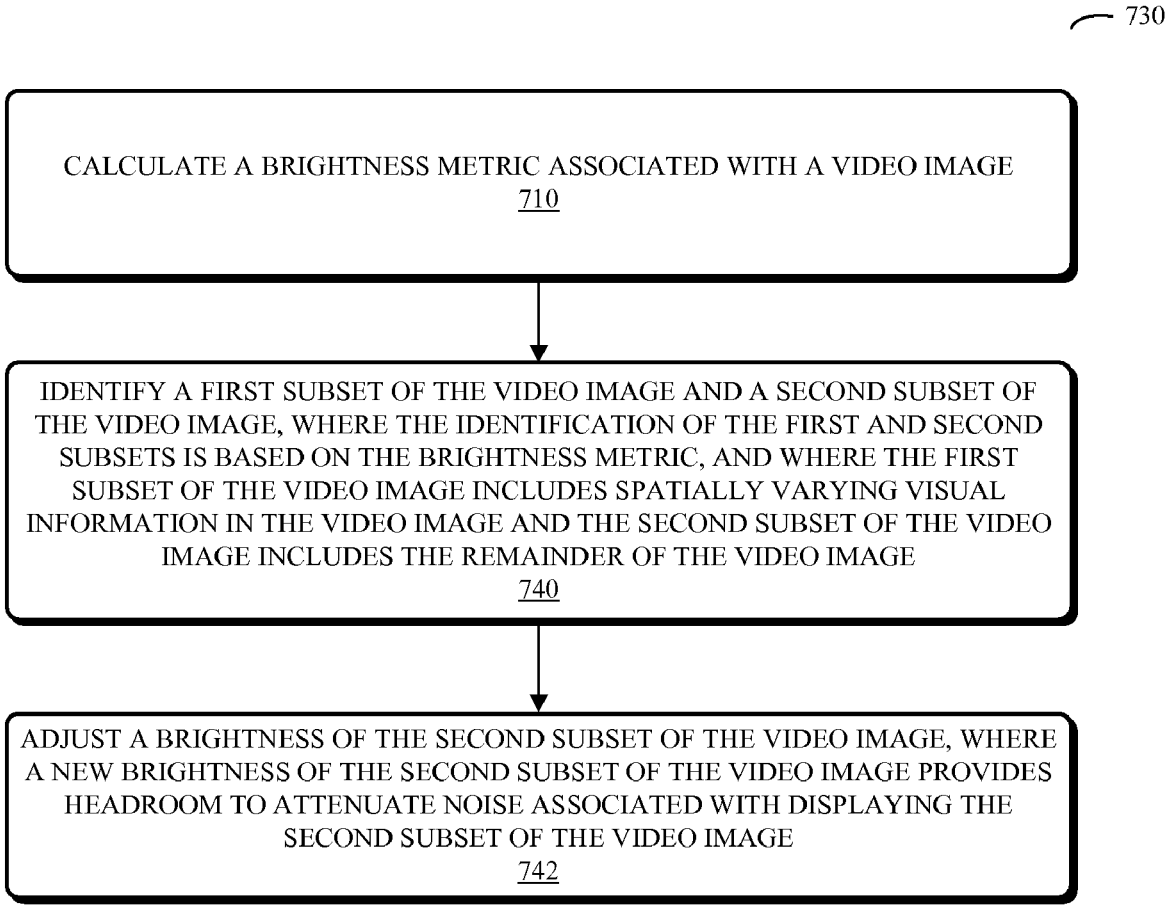
FIG. 7B is a flowchart illustrating a process for adjusting a brightness of a subset of a video image in accordance with an embodiment of the present invention.

FIG. 7B presents a flowchart illustrating a process 730 for adjusting a brightness of a subset of a video image, which may be performed by a system. During operation, this system calculates the brightness metric associated with the video image (710). Next, the system identifies the first subset of the video image and the second subset of the video image based on the brightness metric (740), where the first subset of the video image includes spatially varying visual information in the video image and the second subset of the video image includes the remainder of the video image. Then, the system adjusts the brightness of the second subset of the video image (742), where the new brightness of the second subset of the video image provides headroom to attenuate noise associated with displaying the second subset of the video image.

In an exemplary embodiment, the second subset of the video image includes one or more non-picture portions of the video image, such as one or more black bars. Thus, by scaling the brightness value of the non-picture portion(s) of the video image to be greater than a previous brightness value, perception of changes in the video image associated with backlighting of the display that displays the video image may be reduced.

Figure 7C:
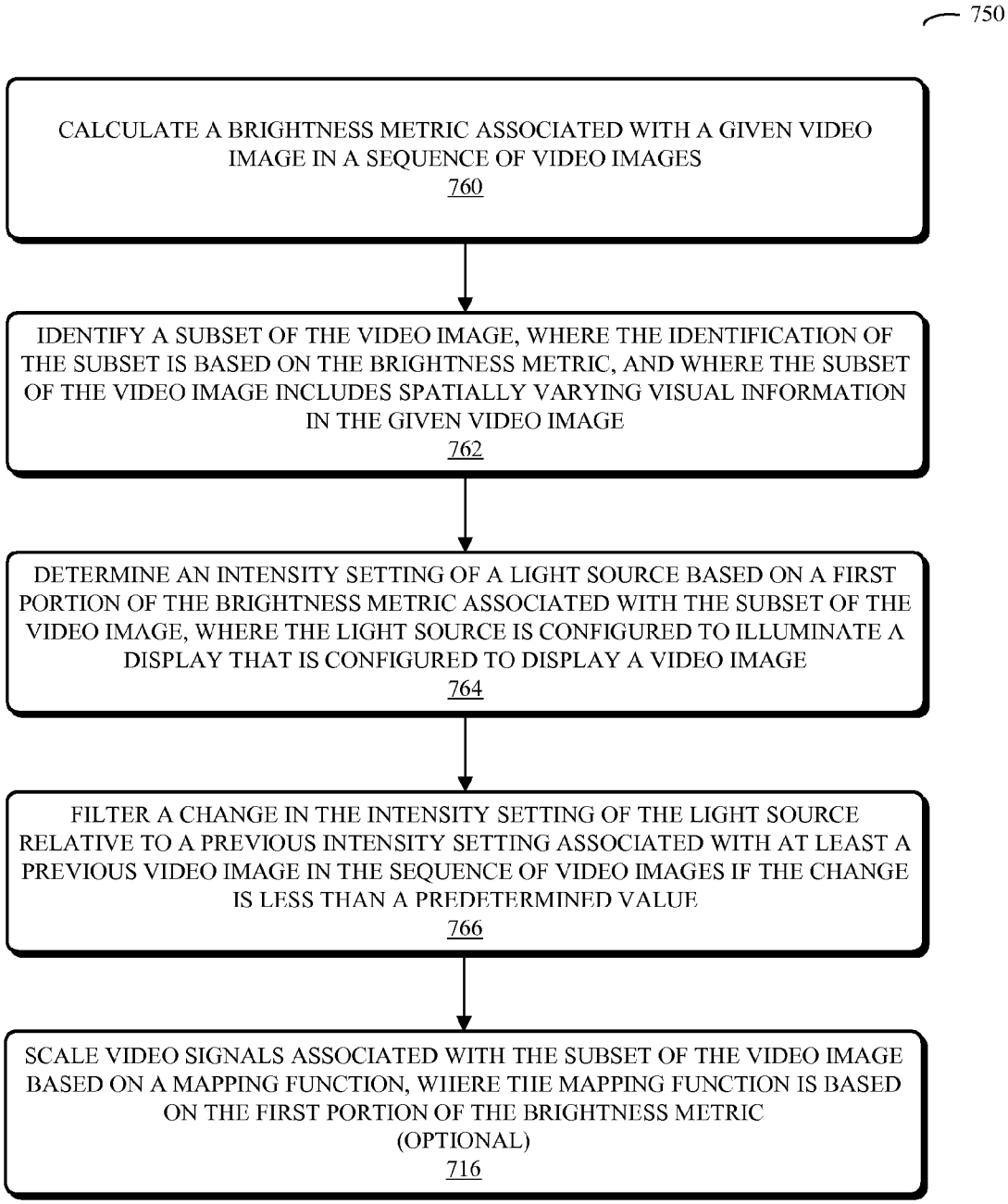
FIG. 7C is a flowchart illustrating a process for determining an intensity of a light source in accordance with an embodiment of the present invention.

FIG. 7C presents a flowchart illustrating a process 750 for determining an intensity of the light source, which may be performed by a system. During operation, this system calculates the brightness metric associated with the given video image in the sequence of video images (760). Next, the system identifies a subset of the given video image based on the brightness metric (762), where the subset of the given video image includes spatially varying visual information in the given video image.

Then, the system determines the intensity setting of the light source based on the first portion of the brightness metric associated with the subset of the given video image (764), where the light source illuminates the display that displays the sequence of video images. Moreover, the system filters the change in the intensity setting of the light source relative to the previous intensity setting associated with at least the previous video image in the sequence of video images if the change is less than the first predetermined value (766).

In some embodiments, the system optionally scales video signals associated with the subset of the video image based on a mapping function (716), where the mapping function is based on the first portion of the brightness metric.

Figure 7D:
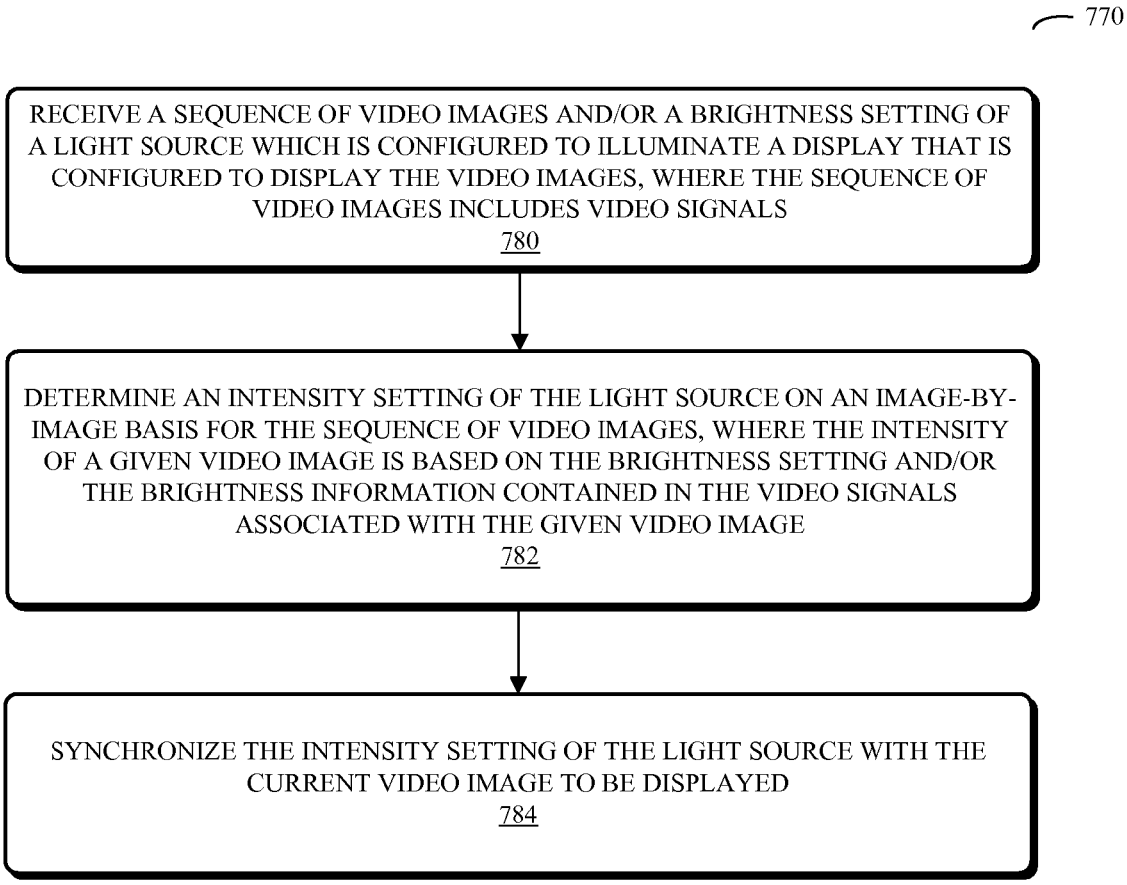
FIG. 7D is a flowchart illustrating a process for synchronizing an intensity of a light source and a video image to be displayed in accordance with an embodiment of the present invention.

FIG. 7D presents a flowchart illustrating a process 770 for synchronizing an intensity of the light source and a video image to be displayed, which may be performed by a system. During operation, this system receives the sequence of video images and/or the brightness setting of the light source that illuminates the display that displays the video images (780), where the sequence of video images includes video signals. Next, the system determines the intensity setting of the light source on an image-by-image basis for the sequence of video images (782), where the intensity of the given video image is based on the brightness setting and/or brightness information contained in the video signals associated with the given video image. Then, the system synchronizes the intensity setting of the light source with the current video image to be displayed (784).

Figure 7E:
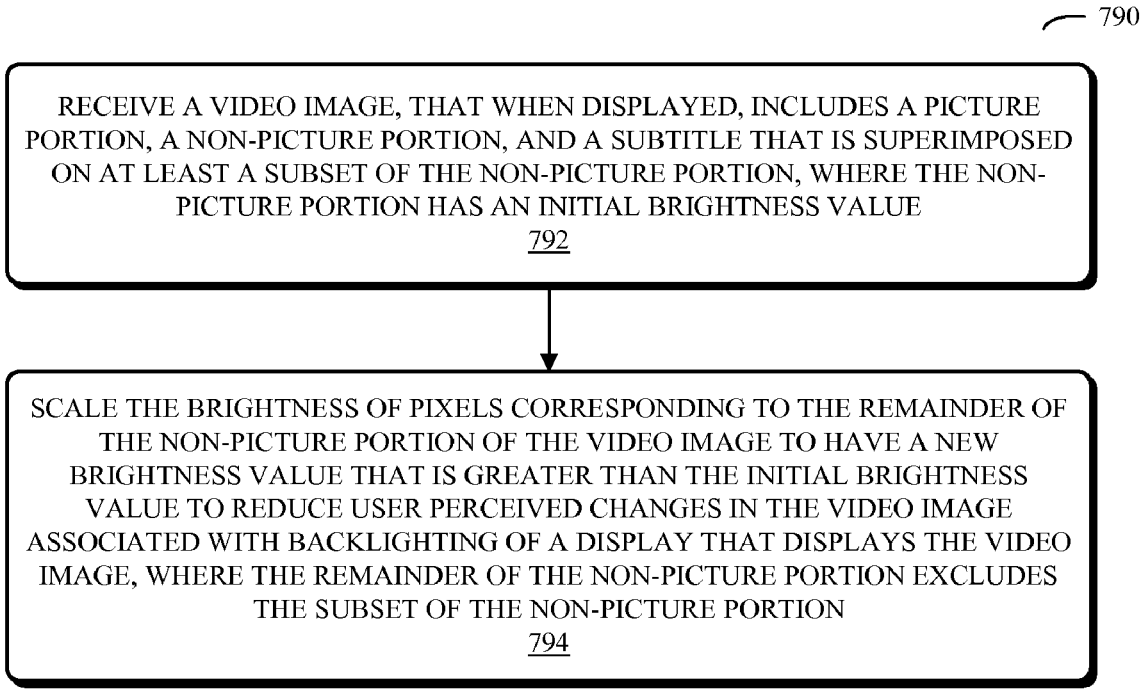
FIG. 7E is a flowchart illustrating a process for adjusting a brightness of a portion of a video image in accordance with an embodiment of the present invention.

FIG. 7E presents a flowchart illustrating a process 790 for adjusting a brightness of a subset of a video image, which may be performed by a system. During operation, this system receives a video image (792), that when displayed, includes a picture portion, a non-picture portion, and a subtitle which is superimposed on at least a subset of the non-picture portion. Note that the non-picture portion has an initial brightness value. Next, the system scales the brightness of pixels corresponding to the remainder of the non-picture portion of the video image to have a new brightness value that is greater than the initial brightness value (794) to reduce user-perceived changes in the video image associated with backlighting of a display that displays the video image. Moreover, note that the remainder of the non-picture portion excludes the subset of the non-picture portion.

Note that in some embodiments of the process 700 (FIG. 7A), 730 (FIG. 7B), 750 (FIG. 7C), 770 (FIG. 7D) and/or 790 there may be additional or fewer operations, the order of the operations may be changed, and two or more operations may be combined into a single operation.

Figure 8:
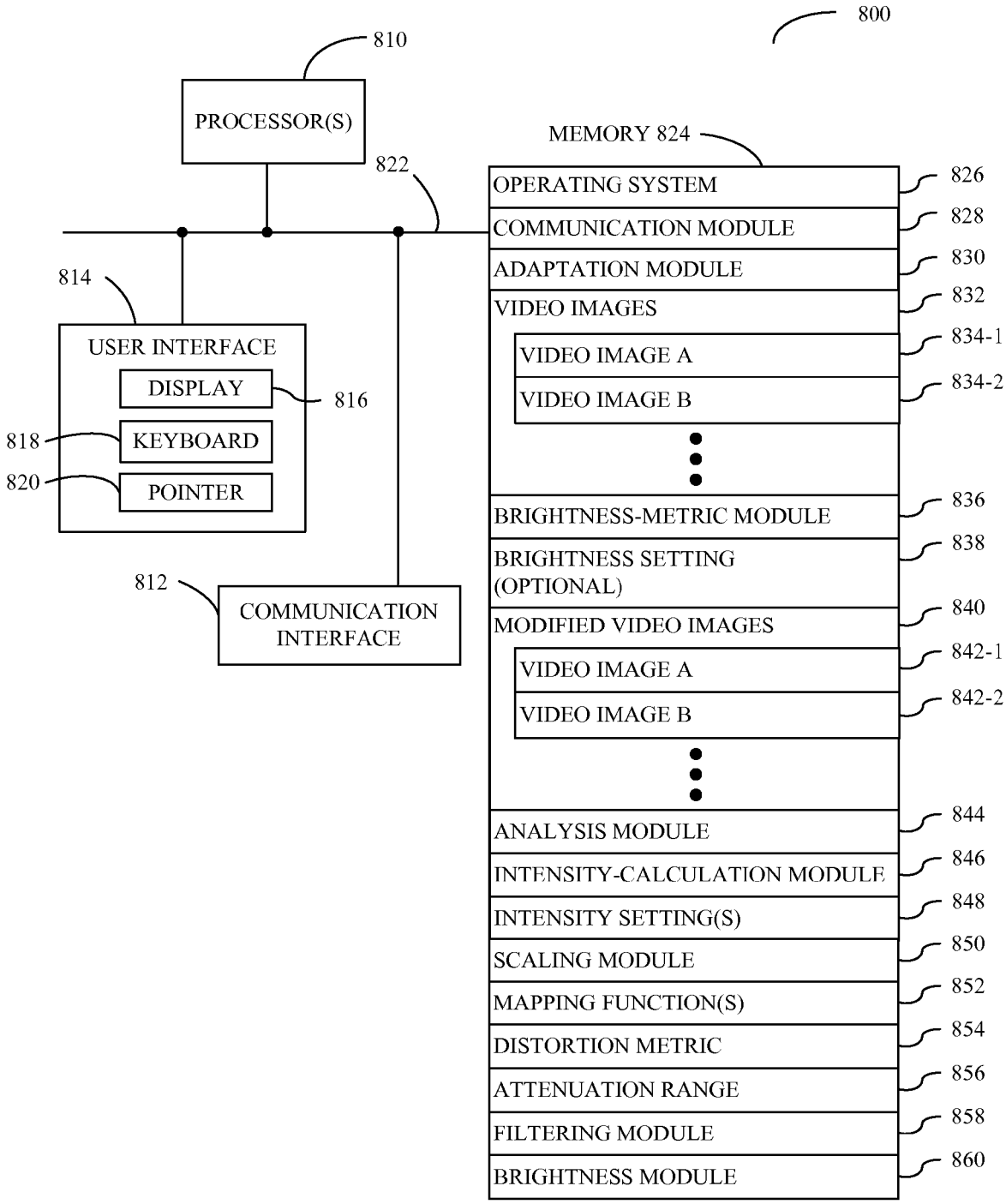
FIG. 8 is a block diagram illustrating a computer system in accordance with an embodiment of the present invention.

Computer systems for implementing these techniques in accordance with embodiments of the invention are now described. FIG. 8 presents a block diagram illustrating an embodiment of a computer system 800. Computer system 800 can include: one or more processors 810, a communication interface 812, a user interface 814, and one or more signal lines 822 electrically coupling these components together. Note that the one or more processing units 810 may support parallel processing and/or multi-threaded operation, the communication interface 812 may have a persistent communication connection, and the one or more signal lines 822 may constitute a communication bus. Moreover, the user interface 814 may include: a display 816, a keyboard 818, and/or a pointer 820, such as a mouse.

Memory 824 in the computer system 800 may include volatile memory and/or non-volatile memory. More specifically, memory 824 may include: ROM, RAM, EPROM, EEPROM, FLASH, one or more smart cards, one or more magnetic disc storage devices, and/or one or more optical storage devices. Memory 824 may store an operating system 826 that includes procedures (or a set of instructions) for handling various basic system services for performing hardware dependent tasks. Memory 824 may also store communication procedures (or a set of instructions) in a communication module 828. These communication procedures may be used for communicating with one or more computers and/or servers, including computers and/or servers that are remotely located with respect to the computer system 800.

Memory 824 may include multiple program modules (or a set of instructions), including: adaptation module 830 (or a set of instructions), brightness-metric module 836 (or a set of instructions), analysis module 844 (or a set of instructions), intensity-calculation module 846 (or a set of instructions), scaling module 850 (or a set of instructions), filtering module 858 (or a set of instructions), and/or brightness module 860 (or a set of instructions). Adaptation module 830 may oversee the determination of intensity setting(s) 848.

In particular, brightness-metric module 836 may calculate one or more brightness metrics (not shown) based on one or more video images 832 (such as video image A 834-1 and/or video image B 834-2) and analysis module 844 may identify one or more subsets of one or more of the video images 832. Then, scaling module 850 may determine and/or use mapping function(s) 852 to scale one or more of the video images 832 to produce one or more modified video images 840 (such as video image A 842-1 and/or video image B 842-2). Note that the mapping function(s) 852 may be based, at least in part, on distortion metric 854 and/or attenuation range 856 of an attenuation mechanism in or associated with display 816.

Based on the modified video images 840 (or equivalently, based on one or more of the mapping functions 852) and optional brightness setting 838, intensity-calculation module 846 may determine the intensity setting(s) 848. Moreover, filtering module 858 may filter changes in the intensity setting(s) 848 and brightness module 860 may adjust the brightness of a non-picture portion of the one or more video images 832.

Instructions in the various modules in the memory 824 may be implemented in a high-level procedural language, an object-oriented programming language, and/or in an assembly or machine language. The programming language may be compiled or interpreted, e.g., configurable or configured to be executed by the one or more processing units 810. Consequently, the instructions may include high-level code in a program module and/or low-level code, which is executed by the processor 810 in the computer system 800.

Although the computer system 800 is illustrated as having a number of discrete components, FIG. 8 is intended to provide a functional description of the various features that may be present in the computer system 800 rather than as a structural schematic of the embodiments described herein. In practice, and as recognized by those of ordinary skill in the art, the functions of the computer system 800 may be distributed over a large number of servers or computers, with various groups of the servers or computers performing particular subsets of the functions. In some embodiments, some or all of the functionality of the computer system 800 may be implemented in one or more ASICs and/or one or more digital signal processors DSPs.

Computer system 800 may include fewer components or additional components. Moreover, two or more components can be combined into a single component and/or a position of one or more components can be changed. In some embodiments the functionality of the computer system 800 may be implemented more in hardware and less in software, or less in hardware and more in software, as is known in the art.

Figure 9:
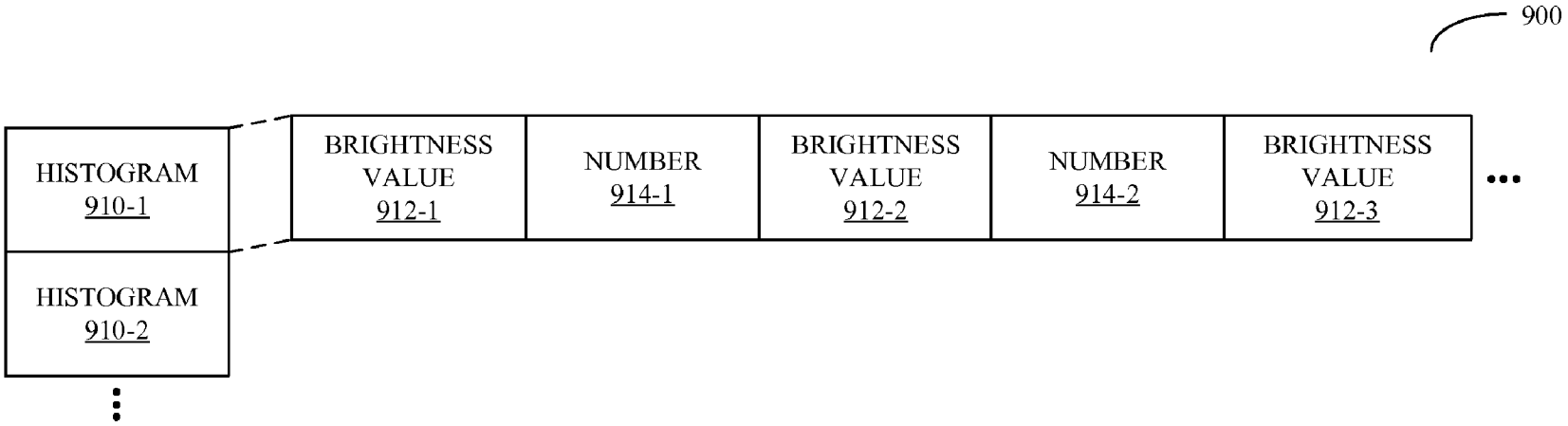
FIG. 9 is a block diagram illustrating a data structure in accordance with an embodiment of the present invention.

Data structures that may be used in the computer system 800 in accordance with embodiments of the invention are now described. FIG. 9 presents a block diagram illustrating an embodiment of a data structure 900. This data structure may include information for one or more histograms 910 of brightness values. A given histogram, such as histogram 910-1, may include multiple numbers 914 of counts and associated brightness values 912.

Figure 10:
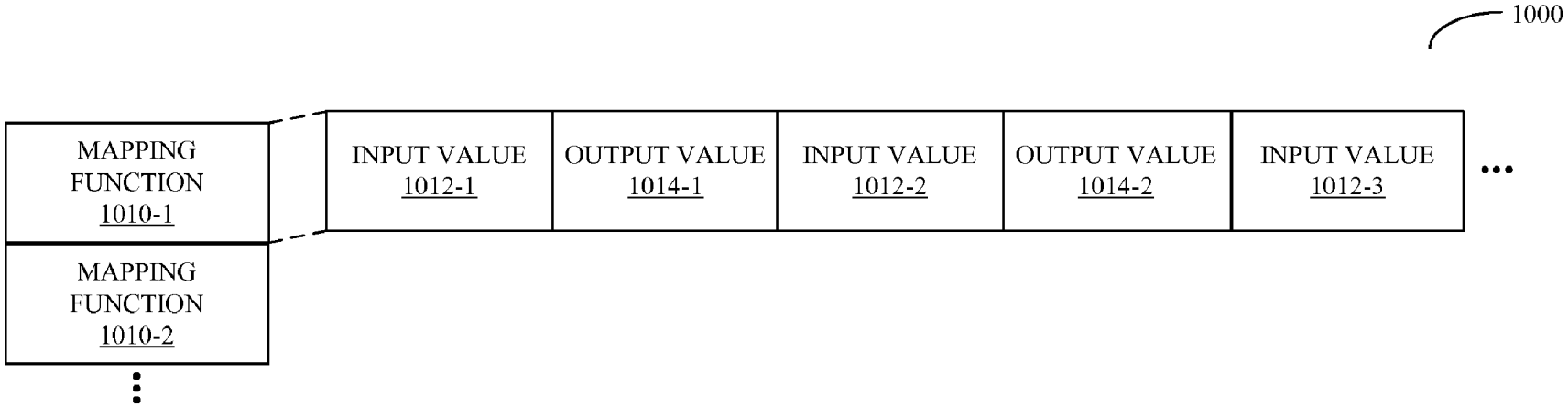
FIG. 10 is a block diagram illustrating a data structure in accordance with an embodiment of the present invention.

FIG. 10 presents a block diagram illustrating an embodiment of a data structure 1000. This data structure may include mapping functions 1010. A given mapping function, such as mapping function 1010-1, may include multiple pairs of input values 1012 and output values 1014, such as input value 1012-1 and output value 1014-1.

Note that that in some embodiments of the data structures 900 (FIG. 9) and/or 1000 there may be fewer or additional components. Moreover, two or more components can be combined into a single component and/or a position of one or more components can be changed.

While brightness has been used as an illustration in the preceding embodiments, in other embodiments these techniques are applied to one or more additional components of the video image, such as one or more color signals.

The foregoing descriptions of embodiments of the present invention have been presented for purposes of illustration and description only. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A system, comprising one or more integrated circuits, wherein the one or more integrated circuits are configured to:

receive a video image, that when displayed, comprises a picture portion, a non-picture portion, and a subtitle which is superimposed on at least a subset of the non-picture portion, the non-picture portion having an initial brightness value; and scale the brightness of pixels corresponding to a remainder of the non-picture portion of the video image to have a new brightness value that is greater than the initial brightness value to reduce user-perceived changes in the video image associated with backlighting of a display that displays the video image, wherein the remainder of the non-picture portion excludes the subset of the non-picture portion.

2. The system of claim 1, wherein the pixels corresponding to the remainder of the non-picture portion are identified based on brightness values in the non-picture portion of the video image that are less than a threshold value.

3. The system of claim 2, wherein the threshold value is associated with the subtitle.

4. The system of claim 3, wherein the one or more integrated circuits are further configured to identify the subtitle and configured to determine the threshold value.

5. The system of claim 1, wherein the one or more integrated circuits are further configured to blend the subtitle with an initial video image to produce the video image.

6. The system of claim 1, wherein the scaling of the brightness of the pixels is performed on a pixel-by-pixel basis.

7. The system of claim 1, wherein the subtitle is dynamically generated and is associated with the video image.

8. The system of claim 1, wherein the video image includes a frame of video.

9. The system of claim 1, wherein the non-picture portion of the video image includes one or more lines.

10. The system of claim 9, wherein the one or more lines are associated with encoding of the video image.

11. The system of claim 1, wherein the non-picture portion of the video image includes a black bar.

12. The system of claim 1, wherein the brightness is scaled based on a histogram of brightness values in the video image.

13. The system of claim 1, wherein a difference between the new brightness value and the initial brightness value is at least 1 candela per square meter.

14. The system of claim 1, wherein the brightness is scaled based on a dynamic range of a mechanism that attenuates coupling of light from a light source to the display that is configured to display the video image.

15. The system of claim 14, wherein the light source comprises a light-emitting diode or a fluorescent lamp.

16. A method for adjusting a brightness of a portion of a video image, comprising:

receiving a video image, that when displayed, comprises a picture portion, the non-picture portion, and a subtitle which is superimposed on at least a subset of the non-picture portion, the non-picture portion having an initial brightness value; and scaling the brightness of pixels corresponding to a remainder of the non-picture portion of the video image to have a new brightness value that is greater than the initial brightness value to reduce user-perceived changes in the video image associated with backlighting of a display that displays the video image, wherein the remainder of the non-picture portion excludes the subset of the non-picture portion.

17. A computer-program product for use in conjunction with a computer system, the computer-program product comprising a computer-readable storage medium and a computer-program mechanism embedded therein for scaling a brightness of a portion of a video image, the computer-program mechanism comprising:

instructions for receiving a video image, that when displayed, comprises a picture portion, the non-picture portion, and a subtitle which is superimposed on at least a subset of the non-picture portion, the non-picture portion having an initial brightness value; and instructions for scaling the brightness of pixels corresponding to a remainder of the non-picture portion of the video image to have a new brightness value that is greater than the initial brightness value to reduce user-perceived changes in the video image associated with backlighting of a display that displays the video image, wherein the remainder of the non-picture portion excludes the subset of the non-picture portion.

18. A computer system to scale a brightness of a portion of a video image, comprising:

a processor;

memory;

a program module, wherein the program module is stored in the memory and configurable to be executed by the processor, the program module including:

instructions for receiving a video image, that when displayed, comprises a picture portion, the non-picture portion, and a subtitle which is superimposed on at least a subset of the non-picture portion, the non-picture portion having an initial brightness value; and instructions for scaling the brightness of pixels corresponding to a remainder of the non-picture portion of the video image to have a new brightness value that is greater than the initial brightness value to reduce user-perceived changes in the video image associated with backlighting of a display that displays the video image, wherein the remainder of the non-picture portion excludes the subset of the non-picture portion.

19. A computer system configured to scale a brightness of a portion of a video image, comprising:

a processor;

a memory;

an instruction fetch unit within the processor configured to fetch:

instructions for receiving a video image, that when displayed, comprises a picture portion, the non-picture portion, and a subtitle which is superimposed on at least a subset of the non-picture portion, the non-picture portion having an initial brightness value; and instructions for scaling the brightness of pixels corresponding to a remainder of the non-picture portion of the video image to have a new brightness value that is greater than the initial brightness value to reduce user-perceived changes in the video image associated with backlighting of a display that displays the video image, wherein the remainder of the non-picture portion excludes the subset of the non-picture portion; and an execution unit within the processor configured to execute the instructions for receiving the video image and the instructions for scaling the brightness of the pixels.

20. An integrated circuit, comprising one or more sub-circuits, wherein the one or more sub-circuits are configured to:

receive a video image, that when displayed, comprises a picture portion, a non-picture portion, and a subtitle which is superimposed on at least a subset of the non-picture portion, the non-picture portion having an initial brightness value; and scale the brightness of pixels corresponding to a remainder of the non-picture portion of the video image to have a new brightness value that is greater than the initial brightness value to reduce user-perceived changes in the video image associated with backlighting of a display that displays the video image, wherein the remainder of the non-picture portion excludes the subset of the non-picture portion.

21. A portable device, comprising:

a display;

a light source configured to output light;

an attenuation mechanism configured to modulate the output light incident on the display, the display configured to display a video image; and one or more integrated circuits, wherein the one or more integrated circuits are configured to:

receive the video image, that when displayed, comprises a picture portion, a non-picture portion, and a subtitle which is superimposed on at least a subset of the non-picture portion, the non-picture portion having an initial brightness value; and scale the brightness of pixels corresponding to a remainder of the non-picture portion of the video image to have a new brightness value that is greater than the initial brightness value to reduce user-perceived changes in the video image associated with backlighting of the display by the light source, wherein the remainder of the non-picture portion excludes the subset of the non-picture portion.

* * * * *